US007667672B2

(12) United States Patent
Cho

(10) Patent No.: US 7,667,672 B2
(45) Date of Patent: Feb. 23, 2010

(54) PLASMA DISPLAY APPARATUS AND METHOD OF DRIVING PLASMA DISPLAY PANEL

(75) Inventor: Janghwan Cho, Seoul (KR)

(73) Assignee: LG Electronics Inc., Seoul (KR)

( * ) Notice: Subject to any disclaimer, the term of this patent is extended or adjusted under 35 U.S.C. 154(b) by 580 days.

(21) Appl. No.: 11/649,817

(22) Filed: Jan. 5, 2007

(65) Prior Publication Data

US 2007/0159414 A1 Jul. 12, 2007

(30) Foreign Application Priority Data

Jan. 6, 2006 (KR) ..... 10-2006-0001966

(51) Int. Cl.
*G09G 3/28* (2006.01)

(52) U.S. Cl. ..... 345/60; 345/66; 345/68; 345/69

(58) Field of Classification Search ..... 345/60, 345/66, 68, 69
See application file for complete search history.

(56) References Cited

U.S. PATENT DOCUMENTS 5,642,018 A 6/1997 Marcotte ..... 315/169.4
6,900,781 B1 * 5/2005 Mori et al. ..... 345/60
2004/0212564 A1 * 10/2004 Lee et al. ..... 345/60
2004/0257304 A1 * 12/2004 Yamamoto et al. ..... 345/60
2005/0140591 A1 6/2005 Holtslag et al. ..... 345/69

FOREIGN PATENT DOCUMENTS

EP 1 152 387 B1 11/2001
EP 1 489 587 A2 12/2004
JP 08-320667 12/1996
JP 09-325735 12/1997
KR 10-2003-0013028 A 2/2003

OTHER PUBLICATIONS

European Search Report dated Feb. 5, 2008.

* cited by examiner

*Primary Examiner*—Richard Hjerpe
*Assistant Examiner*—Saifeldin Elnafia
(74) *Attorney, Agent, or Firm*—Ked & Associates, LLP

(57) ABSTRACT

A plasma display apparatus and a method of driving a plasma display panel are disclosed. The plasma display apparatus includes a plasma display panel including a first electrode and a second electrode, and an integrated sustain driver. The integrated sustain driver supplies a sustain signal of a positive polarity and a sustain signal of a negative polarity to the first electrode during a sustain period. Two light emissions occur during at least one period of a supply period of the sustain signal of the positive polarity or a supply period of the sustain signal of the negative polarity.

18 Claims, 18 Drawing Sheets

Vcp: GND → +Vs

IL1: Decrease

Vcp: Falling from +Vs

IL2: Increase → Decrease

Vcp: Falling to $V_1$

Vcp: Rising from -Vs

IL1: Increase → Decrease

Vcp: Rising to $V_2$

PLASMA DISPLAY APPARATUS AND METHOD OF DRIVING PLASMA DISPLAY PANEL

This Nonprovisional application claims priority under 35 U.S.C. § 119(a) on Patent Application No. 10-2006-0001966 filed in Korea on Jan. 6, 2006 the entire contents of which are hereby incorporated by reference.

BACKGROUND

1. Field

This document relates to a plasma display apparatus and a method of driving a plasma display panel.

2. Description of the Related Art

A plasma display apparatus includes a plasma display panel on which an image is displayed, and a driver for driving the plasma display panel. The driver is adhered to a rear surface of the plasma display panel.

The plasma display panel has the structure in which barrier ribs formed between a front substrate and a rear substrate form a plurality of discharge cells. Each discharge cell is filled with an inert gas containing a main discharge gas such as neon (Ne), helium (He) and a mixture of Ne and He, and a small amount of xenon (Xe). The plurality of discharge cells form one pixel. For example, a red (R) discharge cell, a green (G) discharge cell, and a blue (B) discharge cell form one pixel.

When the plasma display panel is discharged by a high frequency voltage, the inert gas generates vacuum ultraviolet rays, which thereby cause phosphors formed between the barrier ribs to emit light, thus displaying an image. Since the plasma display panel can be manufactured to be thin and light, it has attracted attention as a next generation display device.

SUMMARY

In one aspect, a plasma display apparatus comprises a plasma display panel including a first electrode and a second electrode, and an integrated sustain driver that supplies a sustain signal of a positive polarity and a sustain signal of a negative polarity to the first electrode during a sustain period, wherein two light emissions occur during at least one period of a supply period of the sustain signal of the positive polarity or a supply period of the sustain signal of the negative polarity.

The integrated sustain driver may include an inductor unit for generating mutual inductance.

The integrated sustain driver may generate a first light emission in the plasma display panel by resonance generated between the inductor unit and the plasma display panel. The integrated sustain driver may generate a second light emission in the plasma display panel using a positive sustain voltage supplied from a positive sustain voltage source or a negative sustain voltage supplied from a negative sustain voltage source.

A luminance level of the second light emission may be more than a luminance level of the first light emission.

In another aspect, a plasma display apparatus comprises a plasma display panel including a first electrode and a second electrode, a positive sustain controller that supplies a positive sustain voltage supplied from a positive sustain voltage source to the first electrode during a sustain period, a negative sustain controller that supplies a negative sustain voltage supplied from a negative sustain voltage source to the first electrode during the sustain period, an inductor unit that generates resonance with a plasma display panel and generates mutual inductance, a resonance controller that control the generation of the resonance, a reverse blocking unit that is electrically connected between the inductor unit and the resonance controller and prevents the flowing of an inverse current, and a bypass unit that forms a path of a current generated by the mutual inductance.

The inductor unit may include a first inductor that generates resonance to change a voltage of the first electrode from a negative voltage level to a positive voltage level, and a second inductor that generates resonance to change the voltage of the first electrode from a positive voltage level to a negative voltage level.

Inductance of the first inductor may be equal to inductance of the second inductor.

The resonance controller may include a first resonance switch that controls the generation of resonance for changing the voltage of the first electrode from a negative voltage level to a positive voltage level, and a second resonance switch that controls the generation of resonance for changing the voltage of the first electrode from a positive voltage level to a negative voltage level.

A first light emission may occur in the plasma display panel during a period where the first resonance switch or the second resonance switch is turned on.

The positive sustain controller may include a positive sustain switch, the negative sustain controller may include a negative sustain switch, and at least one of the positive sustain switch or the negative sustain switch may be turned on after the passage of a predetermine period of time from a turn-off time point of the first resonance switch and the second resonance switch.

The predetermine period of time may range from 100 ns to 500 ns.

A second light emission may occur in the plasma display panel during a period where at least one of the positive sustain switch or the negative sustain switch is turned on.

The reverse blocking unit may include a first reverse blocking diode that prevents an inverse current between the first inductor and the first resonance switch, and a second reverse blocking diode that prevents an inverse current between the second inductor and the second resonance switch.

The bypass unit may include a first bypass diode that forms a path of a current generated by an induction voltage of the first inductor induced by the mutual inductance, and a second bypass diode that forms a path of a current generated by an induction voltage of the second inductor induced by the mutual inductance.

In still another aspect, a method of driving a plasma display panel including a first electrode and a second electrode, the method comprises maintaining a voltage of the first electrode at a negative sustain voltage, gradually rising the voltage of the first electrode from the negative sustain voltage to a positive sustain voltage, gradually falling the voltage of the first electrode from the positive sustain voltage to a first voltage, that is lower than the positive sustain voltage and is higher than the ground level voltage, rising the voltage of the first electrode from the first voltage to the positive sustain voltage, maintaining the voltage of the first electrode at the positive sustain voltage, gradually falling the voltage of the first electrode from the positive sustain voltage to the negative sustain voltage, gradually rising the voltage of the first electrode from the negative sustain voltage to a second voltage, that is higher than the negative sustain voltage and is lower than the ground level voltage, and falling the voltage of the first electrode from the second voltage to the negative sustain voltage.

A first light emission may occur in the plasma display panel through at least one of the gradual rising of the voltage of the first electrode from the negative sustain voltage to the positive sustain voltage, or the gradual falling of the voltage of the first electrode from the positive sustain voltage to the negative sustain voltage.

A second light emission may occur in the plasma display panel through at least one of the rising of the voltage of the first electrode from the first voltage to the positive sustain voltage, or the falling of the voltage of the first electrode from the second voltage to the negative sustain voltage.

A luminance level of the second light emission may be more than a luminance level of the first light emission.

BRIEF DESCRIPTION OF THE DRAWINGS

The accompany drawings, which are included to provide a further understanding of the invention and are incorporated on and constitute a part of this specification, illustrate embodiments of the invention and together with the description serve to explain the principles of the invention.

FIGS. 6*a* to 6*m* illustrate operations of the integrated sustain driver of FIG. 4 in accordance with the driving method of FIG. 5.

DETAILED DESCRIPTION OF PREFERED EMBODIMENTS

Reference will now be made in detail embodiments of the invention examples of which are illustrated in the accompanying drawings.

Figure 1:
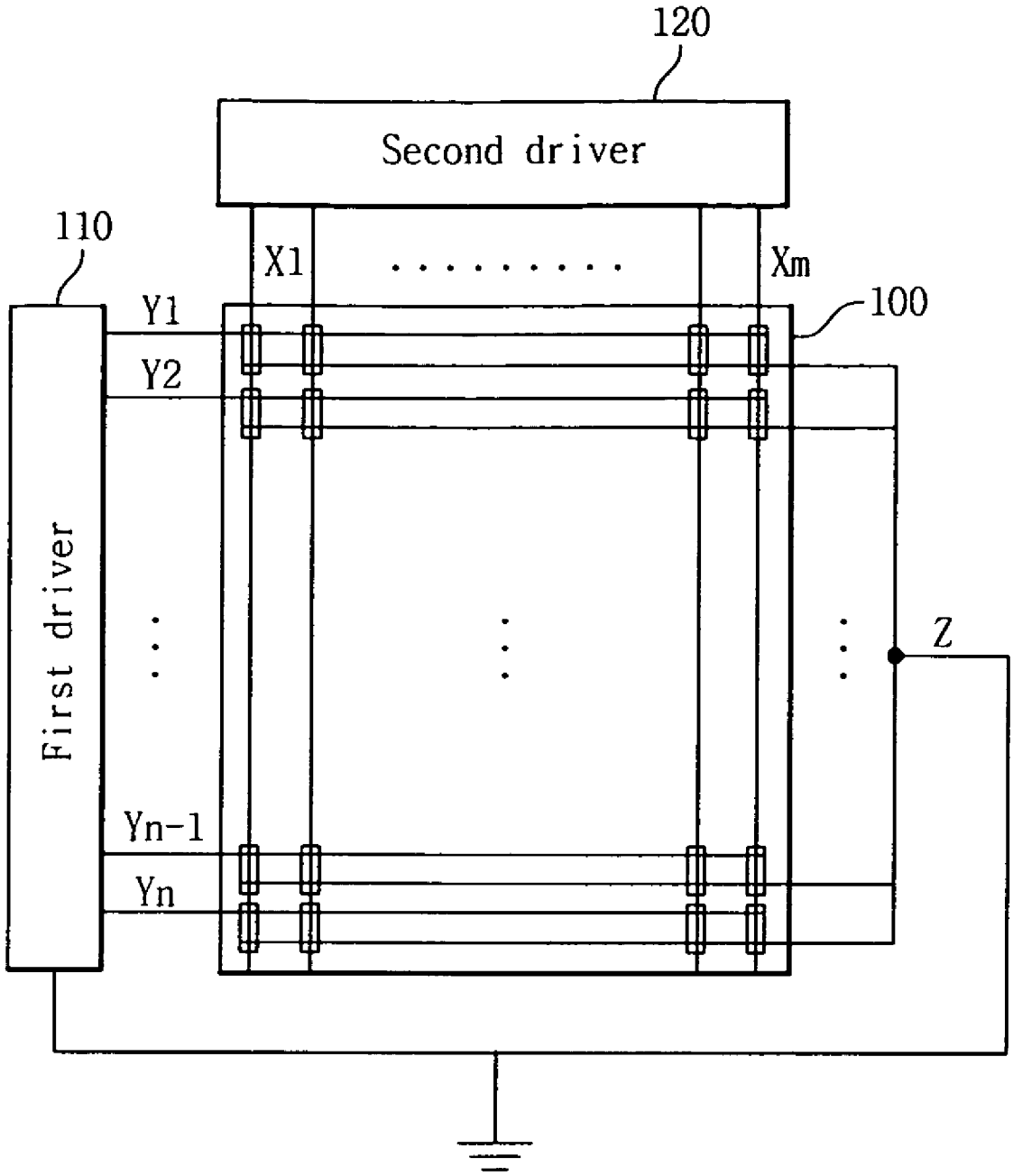
FIG. 1 schematically illustrates a plasma display apparatus according to one embodiment.

FIG. 1 schematically illustrates a plasma display apparatus according to one embodiment.

Referring to FIG. 1, the plasma display apparatus according to one embodiment includes a plasma display panel 100, a first driver 110, and a second driver 120.

The plasma display panel 100 includes a plurality of first electrodes Y1-Yn, a plurality of second electrodes Z, and a plurality of third electrodes X1-Xm intersecting the first electrodes Y1-Yn and the second electrodes Z.

The first driver 110 includes an integrated sustain driver.

The first driver 110 drives the first electrodes Y1-Yn of the plasma display panel 100.

The integrated sustain driver supplies a sustain signal of a positive polarity and a sustain signal of a negative polarity to the plurality of first electrodes Y1-Yn, thereby maintaining a discharge. An image is displayed on the plasma display panel 100 through the maintaining of the discharge.

During at least one period of a supply period of the sustain signal of the positive polarity or a supply period of the sustain signal of the negative polarity, two sustain discharges occur between the first electrodes Y1-Yn and the second electrodes Z such that two light emissions occur inside a discharge cell of the plasma display panel 100.

The first driver 110 may supply a reset signal for uniformizing wall charges accumulated inside the discharge cell to the first electrodes Y1-Yn, and also may supply a scan reference voltage and a scan signal to the first electrodes Y1-Yn.

The second driver 120 includes a data driver. The data driver supplies a data signal to the plurality of third electrodes X1-Xm.

Figure 2:
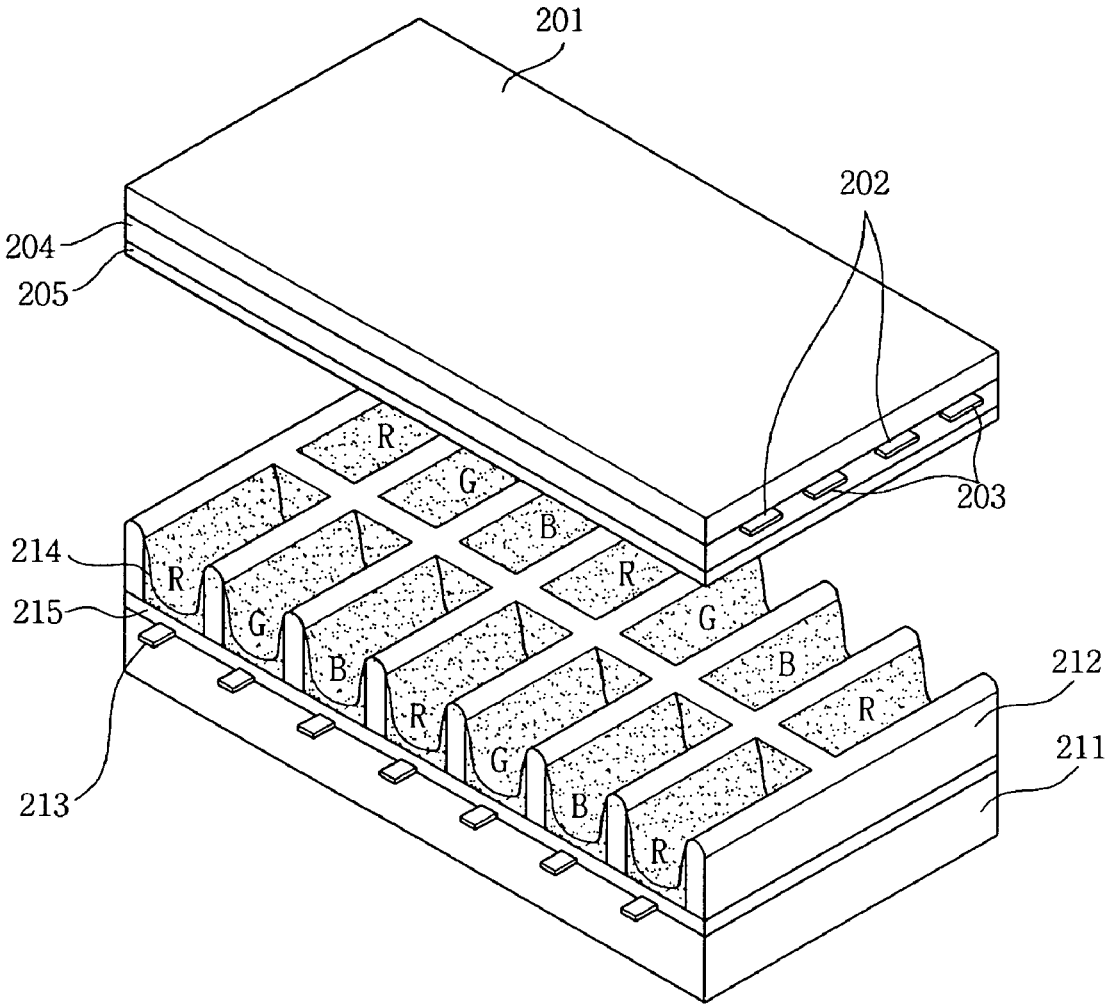
FIG. 2 illustrates one example of a plasma display panel.

FIG. 2 illustrates one example of a plasma display panel.

Referring to FIG. 2, the plasma display panel 100 according to one embodiment includes a front substrate 201 and a rear substrate 211 which are coalesced with each other. On the front substrate 201, a first electrode 202 and a second electrode 203 are positioned in parallel to each other. On the rear substrate 211, a third electrode 213 is positioned to intersect the first electrode 202 and the second electrode 203.

The first electrode 202 and the second electrode 203 generate a discharge inside a discharge cells, and maintain a state of the discharge inside the discharge cell.

An upper dielectric layer 204 for covering the first electrode 202 and the second electrode 203 is formed on an upper portion of the front substrate 201 on which the first electrode 202 and the second electrode 203 are positioned. The upper dielectric layer 204 limits discharge currents of the first electrode 202 and the second electrode 203, and provides insulation between the first electrode 202 and the second electrode 203.

A protective layer 205 is formed on an upper surface of the upper dielectric layer 204 to facilitate discharge conditions. The protective layer 205 may be formed by depositing a material such as magnesium oxide (MgO) on the upper surface of the upper dielectric layer 204.

A lower dielectric layer 215 for covering the third electrode 213 is formed on an upper portion of the rear substrate 211 on which the third electrode 213 is positioned. The lower dielectric layer 215 provides insulation of the third electrode 213.

A plurality of barrier ribs 212 of a stripe type, a well type, a delta type, and the like, are positioned on an upper portion of the lower dielectric layer 215 to partition the discharge cell. A red (R) discharge cell, a green (G) discharge cell, and a blue (B) discharge cell, and the like, are formed between the front substrate 201 and the rear substrate 211. In addition to the red (R), green (G), and blue (B) discharge cells, a white (W) discharge cell or a yellow (Y) discharge cell may be further formed between the front substrate 201 and the rear substrate 211.

While areas of the red (R), green (G), and blue (B) discharge cells may be substantially equal to one another, an area of at least one of the red (R), green (G), and blue (B) discharge cells may be different from areas of the other discharge cells to adjust a color temperature of the red (R), green (G), and blue (B) discharge cells. For example, an area of the red (R) discharge cell may be the smallest, and areas of the green (G) and blue (B) discharge cells may be more than the area of the red (R) discharge cell.

While FIG. 2 has illustrated a case where heights of the plurality of barrier ribs 212 are equal to one another, a height of the barrier rib 212 positioned parallel to the first and second electrodes 202 and 203 may be less than a height of the barrier rib 212 positioned parallel to the third electrode 213.

Each of the discharge cells partitioned by the barrier rib 112 is filled with a predetermined discharge gas.

A phosphor layer 214 for emitting visible light for an image display during an address discharge is positioned inside the discharge cell partitioned by the barrier rib 212. For instance, red (R), green (G) and blue (B) phosphor layers may be formed inside the discharge cells. A white (W) phosphor layer and/or a yellow (Y) phosphor layer may be further formed in addition to the red (R), green (G) and blue (B) phosphor layers.

Figure 3:
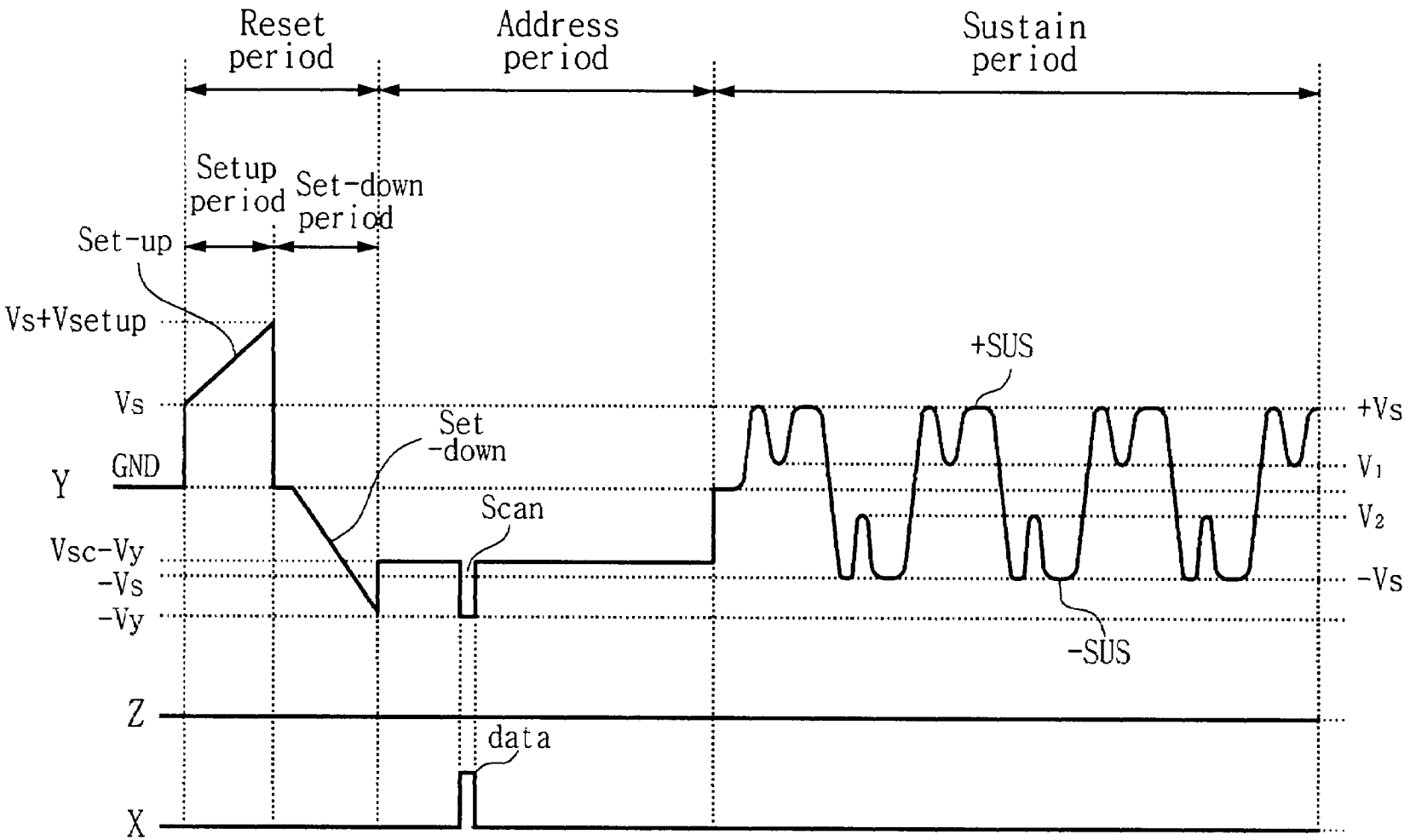
FIG. 3 illustrates one example of a method of driving a plasma display panel.

FIG. 3 illustrates one example of a method of driving a plasma display panel.

As illustrated in FIG. 3, the first driver 110 and the second driver 120 each supply a driving signal during a reset period, an address period, and a sustain period.

During a setup period of a reset period, the first driver 110 supplies a setup signal (set-up) to the first electrode Y, thereby generating a weak dark discharge (i.e., a setup discharge) within the discharge cells of the whole screen. This results in wall charges of a positive polarity being accumulated on the second electrode Z and the third electrode X, and wall charges of a negative polarity being accumulated on the first electrode Y.

During a set-down period of the reset period, the first driver 110 supplies a set-down signal (set-down) to the first electrode Y. The set-down signal (set-down) falls from a positive voltage level lower than the highest voltage of the setup signal (set-up) to a given voltage equal to or lower than a ground level voltage GND. The set-down signal (set-down) generates a weak erase discharge (i.e., a set-down discharge) inside the discharge cells. Furthermore, the set-down signal (set-down) erase a portion of wall charges excessively formed inside the discharge cell such that the remaining wall charges are uniform inside the discharge cell to the extent that the address discharge can be stably performed.

During an address period, the first driver 110 supplies a scan signal (Scan) of a negative polarity falling from a scan bias voltage (Vsc-Vy) to the first electrode Y. At the same time, the data driver of the second driver 120 supplies a data pulse (data) of a positive polarity corresponding to the scan signal (Scan) to the third electrode X. As the voltage difference between the scan signal (Scan) and the data pulse (data) is added to a wall voltage generated during the reset period, the address discharge occurs within the discharge cells to which the data signal (data) is supplied. Wall charges are formed inside the discharge cell selected by performing the address discharge such that when a positive sustain voltage +Vs is supplied a discharge occurs. Accordingly, the first electrode Y is scanned.

During a sustain period, the integrated sustain driver of the first driver 110 supplies a sustain signal (+SUS) of a positive polarity and a sustain signal (−SUS) of a negative polarity to the first electrode Y.

As a wall voltage within the discharge cell selected by performing the address discharge is added to the sustain signal (+SUS) of the positive polarity or the sustain signal (−SUS) of the negative polarity, a sustain discharge occurs between the scan electrode and the sustain electrode.

During at least one period of a supply period of the sustain signal (+SUS) of the positive polarity or a supply period of the sustain signal (−SUS) of the negative polarity, two sustain discharges occur between the first electrode Y and the second electrode Z such that two light emissions occur inside the discharge cell of the plasma display panel.

While a voltage of the first electrode Y changes from the positive sustain voltage +Vs to a negative sustain voltage −Vs or from the negative sustain voltage −Vs to the positive sustain voltage +Vs, a first light emission occurs due to resonance between an inductor generating mutual inductance and the plasma display panel.

While the sustain signal (+SUS) of the positive polarity gradually falls from the positive sustain voltage +Vs to a first voltage V1 and then rises from the first voltage V1 to the positive sustain voltage +Vs due to the positive sustain voltage +Vs supplied from a positive sustain voltage source, a second light emission occurs. Further, while the sustain signal (−SUS) of the negative polarity gradually rises from the negative sustain voltage −Vs to a second voltage V2 and then falls from the second voltage V2 to the negative sustain voltage −Vs due to the negative sustain voltage −Vs supplied from a negative sustain voltage source, the second light emission occurs.

A luminance level of the second light emission is more than a luminance level of the first light emission.

During at least one period where the sustain signal (+SUS) of the positive polarity or the sustain signal (−SUS) of the negative polarity is supplied, two light emissions occur inside the discharge cell of the plasma display panel such that luminance greatly increases.

The first voltage V1 is lower than the positive sustain voltage +Vs and is higher than the ground level voltage GND. The second voltage V2 is higher than the negative sustain voltage −Vs and is lower than the ground level voltage GND. A voltage difference between the first voltage V1 and the positive sustain voltage +Vs and a voltage difference between the second voltage V2 and the negative sustain voltage −Vs each range from 150V to 180V.

Figure 4:
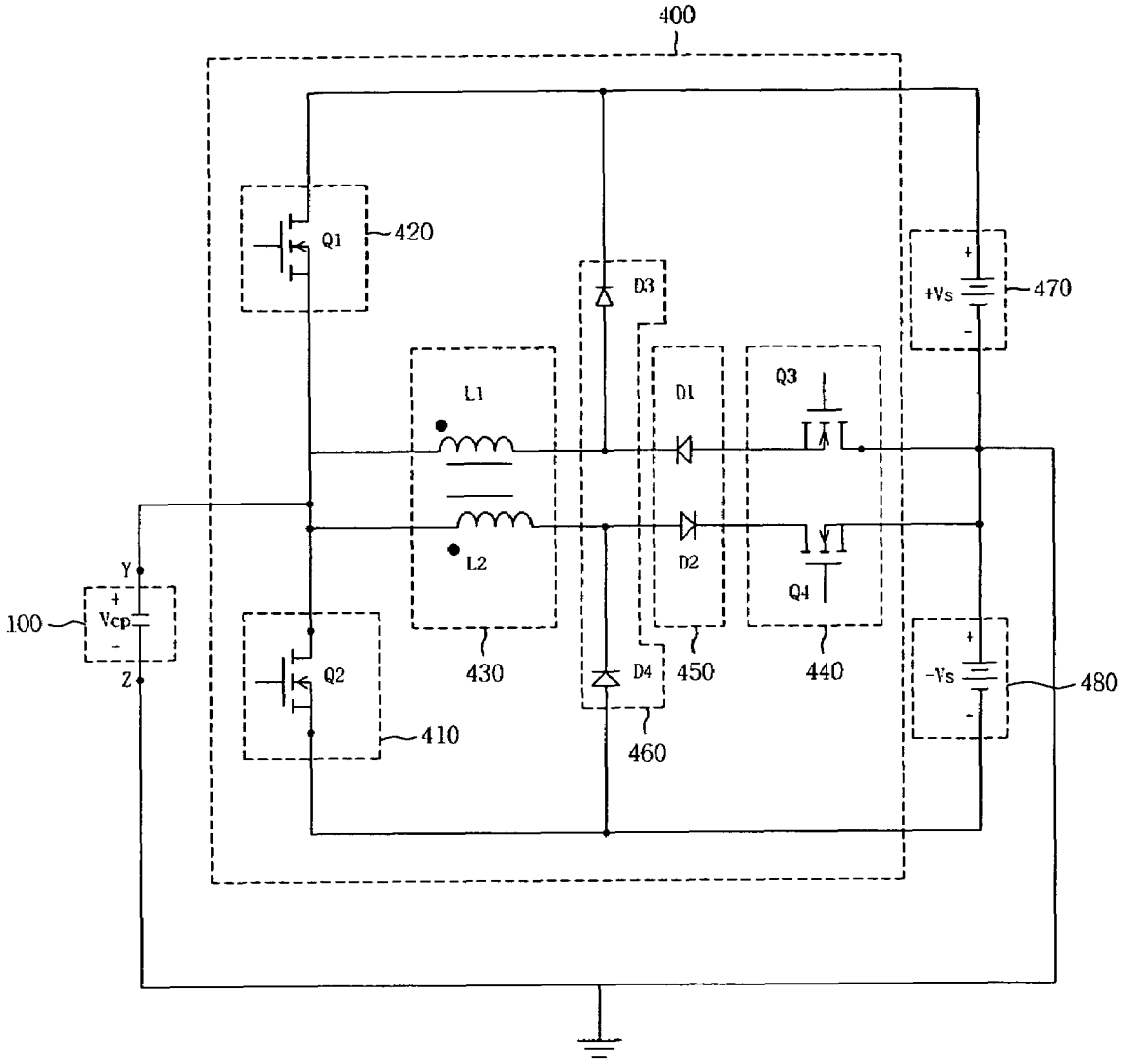
FIG. 4 illustrates an integrated sustain driver.

FIG. 4 illustrates an integrated sustain driver.

As illustrated in FIG. 4, an integrated sustain driver 400 includes a negative sustain controller 410, a positive sustain controller 420, an inductor unit 430, a resonance controller 440, a reverse blocking unit 450, and a bypass unit 460.

The positive sustain controller 420 includes a positive sustain switch Q1. The positive sustain controller 420 supplies a positive sustain voltage +Vs supplied from a positive sustain voltage source 470 (+Vs) to the first electrode Y during the sustain period.

The negative sustain controller 410 includes a negative sustain switch Q2. The negative sustain controller 410 supplies a negative sustain voltage −Vs supplied from a negative sustain voltage source 480 (−Vs) to the first electrode Y during the sustain period.

The inductor unit 430 forms resonance with the plasma display panel 100 including the first electrode Y and the second electrode Z, and generates mutual inductance. The inductor unit 430 includes a first inductor L1 and a second inductor L2. The first inductor L1 forms resonance to change a voltage of the first electrode Y from a negative voltage to a positive voltage. The second inductor L2 forms resonance to change the voltage of the first electrode Y from a positive voltage to a negative voltage.

The resonance controller 440 controls the generation of the resonance between the plasma display panel 100 and the first inductor L1 or the second inductor L2. The resonance controller 440 includes a first resonance switch Q3 and a second resonance switch Q4. The first resonance switch Q3 controls the generation of the resonance between the first inductor L1 and the plasma display panel 100 for changing the voltage of the first electrode Y from a negative voltage to a positive voltage. The second resonance switch Q4 controls the generation of the resonance between the second inductor L2 and the plasma display panel 100 for changing the voltage of the first electrode Y from a positive voltage to a negative voltage.

The reverse blocking unit 450 is electrically connected between the inductor unit 430 and the resonance controller 440 to prevent an inverse current between the inductor unit 430 and the resonance controller 440. The reverse blocking unit 450 includes a first reverse blocking diode D1 and a second reverse blocking diode D2. The first reverse blocking diode D1 prevents an inverse current between the first inductor L1 and the first resonance switch Q3. The second reverse blocking diode D2 prevents an inverse current between the second inductor L2 and the second resonance switch Q4.

The bypass unit 460 forms a path of a current generated by the mutual inductance. The bypass unit 460 includes a first bypass diode D3 and a second bypass diode D4. The first bypass diode D3 forms a path of a current generated by an induction voltage of the first inductor L1 induced by mutual inductance. The second bypass diode D4 forms a path of a current generated by an induction voltage of the second inductor L2 induced by mutual inductance.

Figure 5:
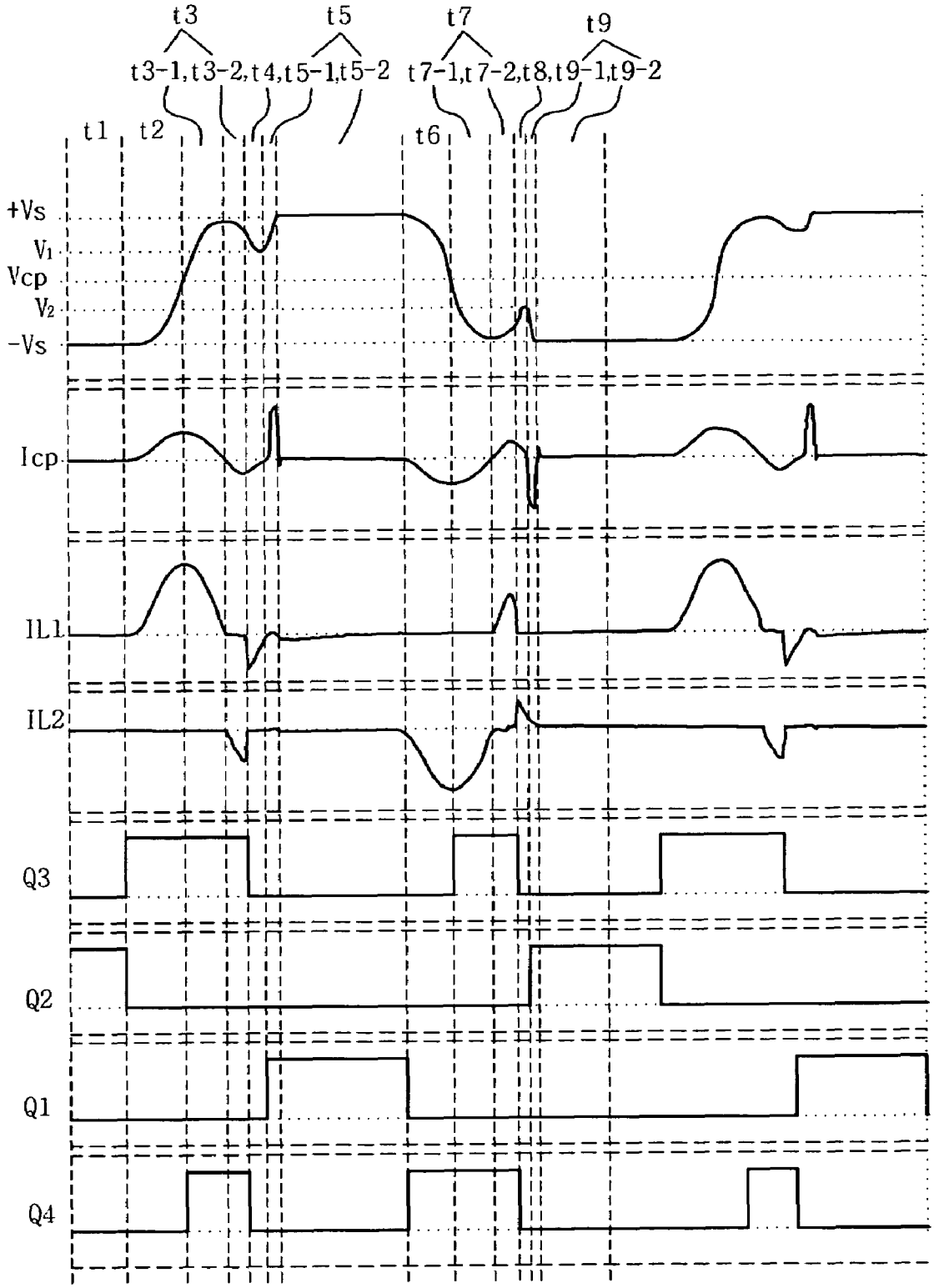
FIG. 5 illustrates one example of a method of driving the integrated sustain driver of FIG. 4.

FIG. 5 illustrates one example of a method of driving the integrated sustain driver of FIG. 4. FIGS. 6*a* to 6*m* illustrate operations of the integrated sustain driver of FIG. 4 in accordance with the driving method of FIG. 5.

In FIG. 5, Vcp indicates a voltage of the first electrode Y based on the second electrode Z in the plasma display panel 100. Icp indicates a current charged to the first electrode Y. IL1 indicates a current of the first inductor L1, and IL2 indicates a current of the second inductor L2. Q1 to Q4 indicate switch timing each of the switches Q1 to Q4.

One example of a method of driving the plasma display panel 100 includes, (1) during a period t1, maintaining a voltage Vcp of the first electrode Y of the plasma display panel 100 at the negative sustain voltage −Vs, (2) during periods t2 and t3-1, gradually rising the voltage Vcp of the first electrode Y from the negative sustain voltage −Vs to the positive sustain voltage +Vs, (3) during periods t3-2 and t4, gradually falling the voltage Vcp of the first electrode Y from the positive sustain voltage +Vs to the first voltage V1 that is lower than the positive sustain voltage +Vs and is higher than the ground level voltage GND, (4) during a period t5-1, again rising the voltage Vcp of the first electrode Y from the first voltage V1 to the positive sustain voltage +Vs, (5) during a period t5-2, maintaining the voltage Vcp of the first electrode Y at the positive sustain voltage +Vs, (6) during periods t6 and t7-1, gradually falling the voltage Vcp of the first electrode Y from the positive sustain voltage +Vs to the negative sustain voltage −Vs, (7) during periods t7-2 and t8, gradually rising the voltage Vcp of the first electrode Y from the negative sustain voltage −Vs to the second voltage V2 that is higher than the negative sustain voltage −Vs and is lower than the ground level voltage GND, (8) during a period t9-1, falling the voltage Vcp of the first electrode Y from the second voltage V2 to the negative sustain voltage −Vs, and (9) during a period t9-2, maintaining the voltage Vcp of the first electrode Y at the negative sustain voltage −Vs.

As above, a sustain discharge occurs inside the discharge cell of the plasma display panel 100 through the gradual rising of the voltage Vcp of the first electrode Y from the negative sustain voltage −Vs to the positive sustain voltage +Vs and the gradual falling of the voltage Vcp of the first electrode Y from the positive sustain voltage +Vs to the negative sustain voltage −Vs, and a first light emission is caused by the sustain discharge. Further, a sustain discharge occurs inside the discharge cell of the plasma display panel 100 through the rising of the voltage Vcp of the first electrode Y from the first voltage V1 to the positive sustain voltage +Vs and the falling of the voltage Vcp of the first electrode Y from the second voltage V2 to the negative sustain voltage −Vs, and a second light emission is caused by the sustain discharge.

A luminance level of the second light emission is more than a luminance level of the first light emission.

The following is a detailed description of an operation of a driving circuit in accordance with the driving method of the panel of FIG. 5, with reference to FIGS. 6*a* to 6*m*.

Figure 6A:
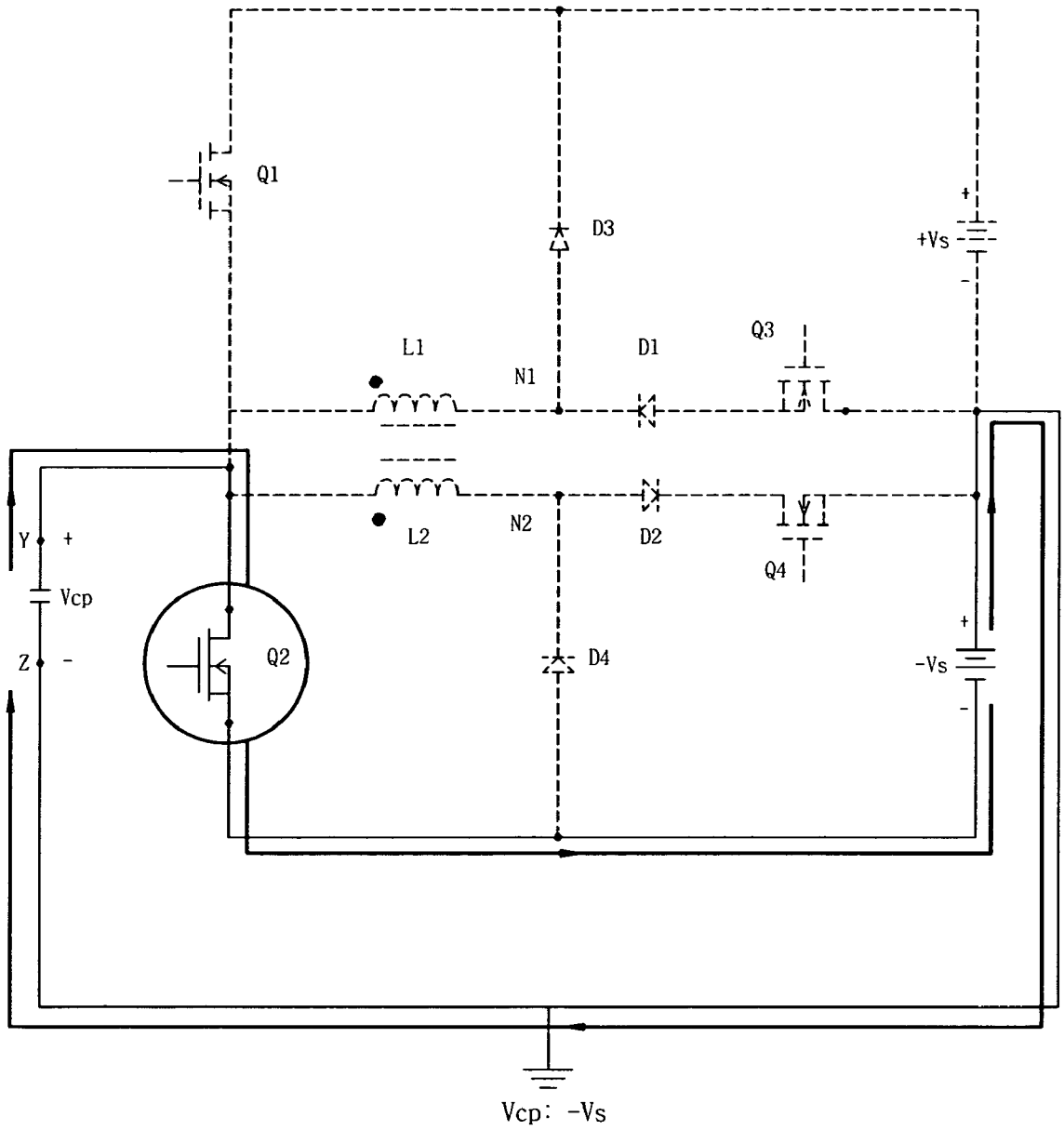

As illustrated in FIG. 6*a*, the negative sustain switch Q2 is turned on during the period t1 such that a current path passing through the negative sustain voltage source (−Vs), the second electrode Z, the first electrode Y, the negative sustain switch Q2, and the negative sustain voltage source (−Vs) is formed.

The voltage Vcp of the first electrode Y of the plasma display panel 100 is maintained at the negative sustain voltage −Vs through the current path during the period t1.

Figure 6B:
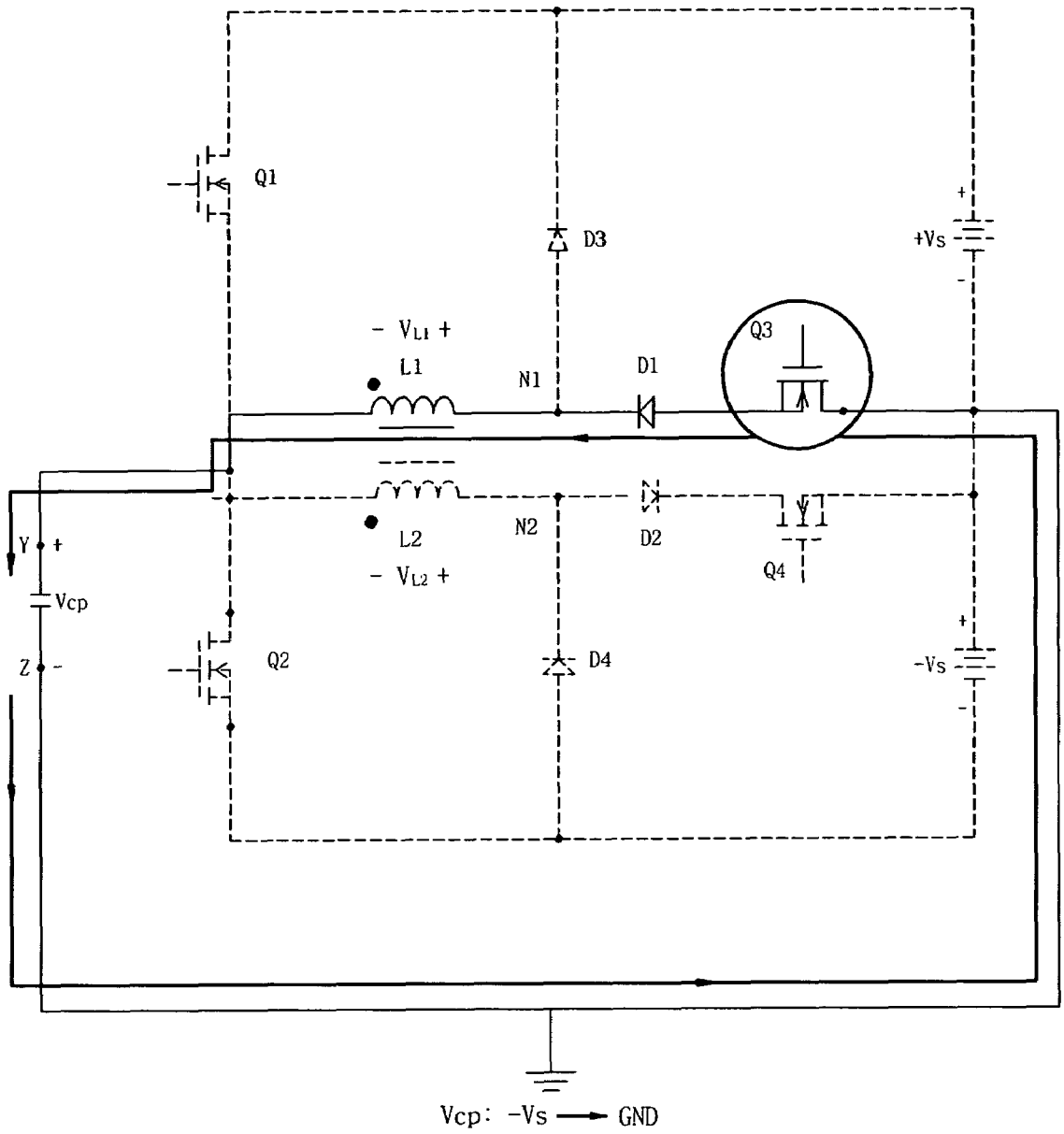

As illustrated in FIG. 6*b*, the first resonance switch Q3 is turned on during the period t2 such that a current path passing through the second electrode Z, the first resonance switch Q3, the first reverse blocking diode D1, the first inductor L1, and the first electrode Y is formed.

Resonance occurs between the first inductor L1 and the plasma display panel 100 through the current path such that the voltage Vcp of the first electrode Y rises from the negative sustain voltage −Vs to the ground level voltage GND.

Figure 6C:
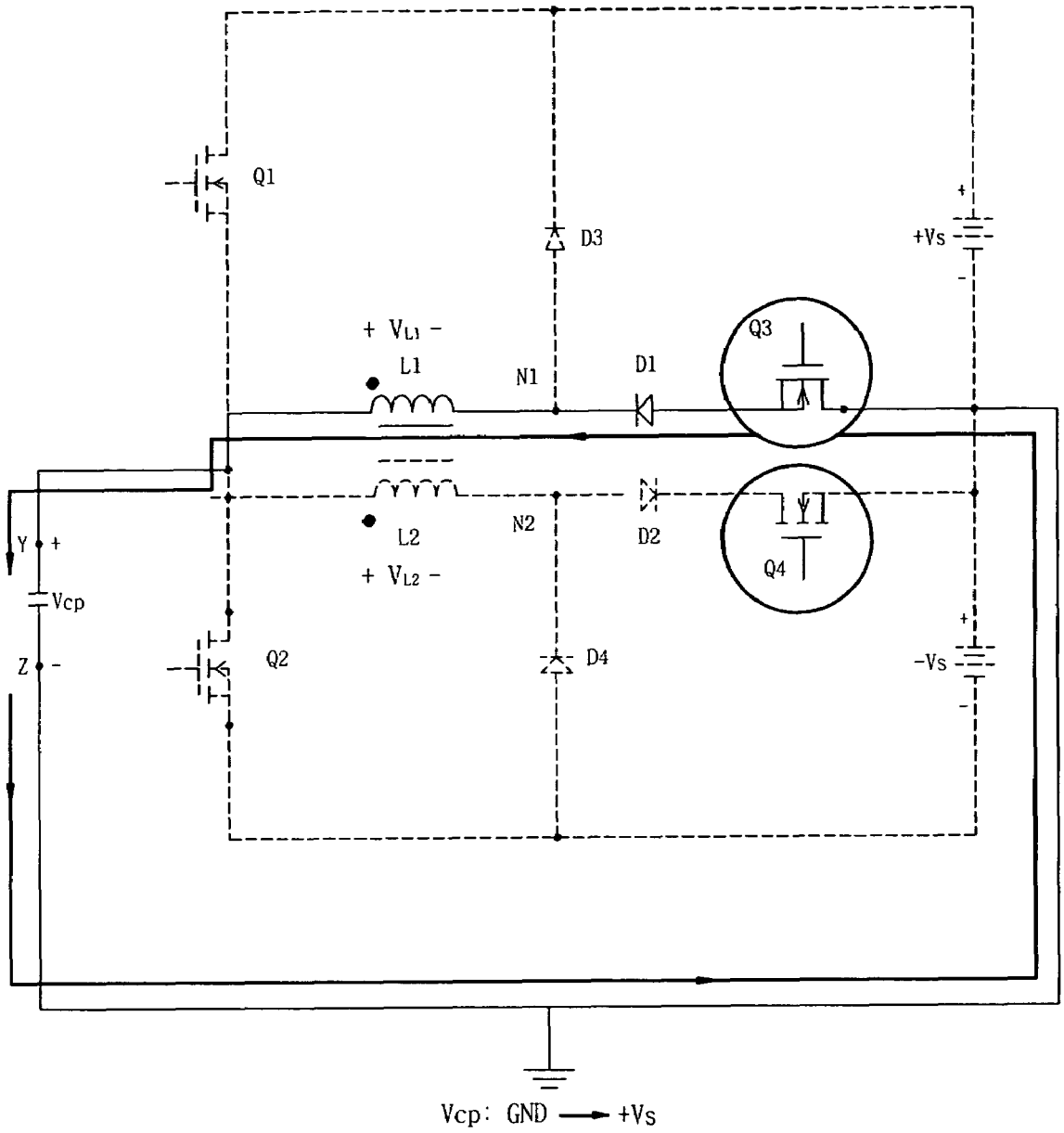

As illustrated in FIG. 6*c*, the first resonance switch Q3 remains in a turn-on state and the second resonance switch Q4 is turned on during the period t3-1 such that a current path passing through the second electrode Z, the first resonance switch Q3, the first reverse blocking diode D1, the first inductor L1, and the first electrode Y is formed.

The resonance generated between the first inductor L1 and the plasma display panel 100 is maintained through the current path such that the voltage Vcp of the first electrode Y rises from the ground level voltage GND to the positive sustain voltage +Vs. Accordingly, a sustain discharge occurs inside the discharge cell of the plasma display panel 100 such that the first light emission is caused by the sustain discharge. While charging a current discharged from the second electrode Z to the first electrode Y, the first light emission occurs due to the charging current Icp to the first electrode Y.

A reason why a current path passing from the second inductor L2 toward the second reverse blocking diode D2 is not formed is that a voltage of the second node N2 is less than the ground level voltage GND due to a voltage $V_{L2}$ of the second inductor L2 formed by mutual inductance. A reason why a current path passing from the second bypass diode D4 toward the second inductor L2 is not formed is that the voltage of the second node N2 is more than the negative sustain voltage −Vs.

As above, during the periods t2 and t3-1, the voltage Vcp of the first electrode Y changes from the negative sustain voltage −Vs to the positive sustain voltage +Vs due to the resonance generated between the first inductor L1 and the plasma display panel 100.

Figure 6D:
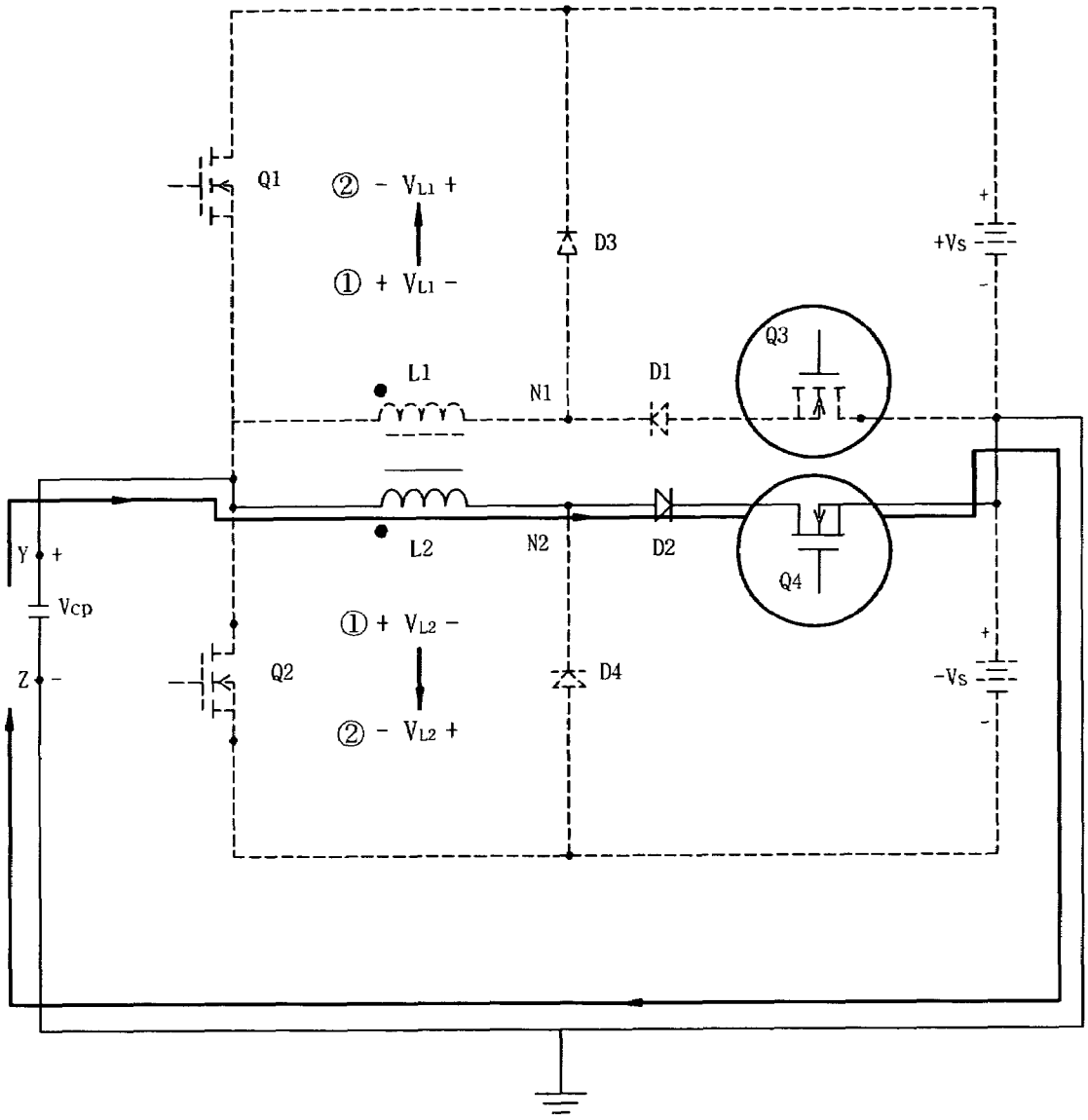

As illustrated in FIG. 6*d*, the first and second resonance switches Q3 and Q4 remain in a turn-on state during the period t3-2. Since the first and second resonance switches Q3 and Q4 remain in the turn-on state after the voltage Vcp of the first electrode Y rises to the positive sustain voltage +Vs due to the resonance, a current Icp charged to the first electrode Y is discharged again. A current path passing through the first electrode Y, the second inductor L2, the second reverse blocking diode D2, the second resonance switch Q4, and the second electrode Z is formed.

The voltage Vcp of the first electrode Y falls from the positive sustain voltage +Vs, and a current IL2 flows in the second inductor L2 through the current path. As the current IL2 of the second inductor L2 gradually increases, a voltage (□ $V_{L2}$) is induced to both terminals of the second inductor L2 and a voltage (□ $V_{L1}$) is induced to both terminals of the first inductor L1 due to mutual inductance depending on an increase in the current IL2.

Since the voltage of the second node n2 is higher than the negative sustain voltage −Vs, a current does not flows in the second bypass diode D4. A reason why a current path passing from the first inductor L1 toward the first reverse blocking diode D1 and a current path passing from the first inductor L1 toward the first bypass diode D3 are not formed is that a voltage of the first node N1 is higher than the ground level voltage GND and is lower than the positive sustain voltage +Vs due to the voltage (□ $V_{L1}$) induced to both terminals of the first inductor L1 due to the mutual inductance.

The period t3-2 ends and at the same time, the first and second resonance switches Q3 and Q4 are turned off. Therefore, the current IL2 flowing in the second inductor L2 is instantaneously reduced such that a voltage (□ $V_{L2}$) is induced to both terminals of the second inductor L2 and a voltage (□ $V_{L1}$) is induced to both terminals of the first inductor L1 due to mutual inductance. Magnitudes of the voltages (□$V_{L1}$) and (□$V_{L2}$) are equal to magnitudes of the voltages (□$V_{L1}$) and (□$V_{L2}$), respectively. Directions of the voltages (□$V_{L1}$) and (□$V_{L2}$) are opposite to directions of the voltages (□ $V_{L1}$) and (□ $V_{L2}$), respectively.

Figure 6E:
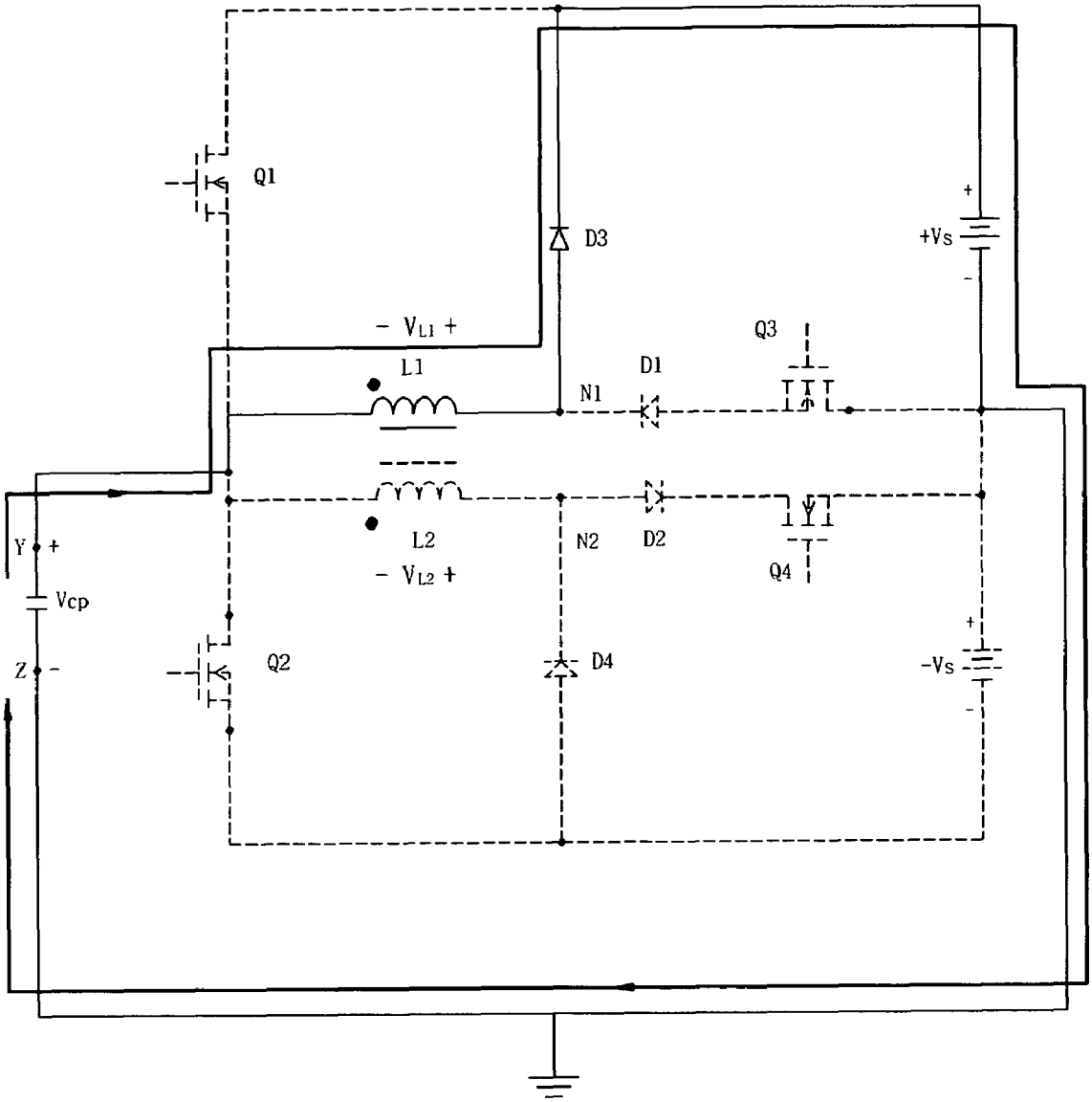

As illustrated in FIG. 6*d*, while the first and second resonance switches Q3 and Q4 are turned off during the period t4, the voltage (□ $V_{L1}$) is induced to both terminals of the first inductor L1 such that a sum (i.e., the voltage of the first node N1) of the voltage Vcp of the first electrode Y and the voltage $V_{L1}$ are higher than the positive sustain voltage +Vs. Accordingly, as illustrated in FIG. 6*e*, a current path passing through the first electrode Y, the first inductor L1, the first bypass-diode D3, the positive sustain voltage source (+Vs), and the second electrode Z is formed during the period t4. The voltage Vcp of the first electrode Y falls to the first voltage V1 through the current path.

As the induction voltage $V_{L1}$ gradually decreases, an induced current IL1 flowing in the first inductor L1 gradually decreases such that the current IL1 of the first inductor L1 is formed during the period t4 as illustrated in FIG. 5.

The magnitude of the first voltage V1 is determined by a length of the period t4 ranging from a turn-off time point of the first and second resonance switches Q3 and Q4 to a turn-on time point of the positive sustain switch Q1.

The length of the period t4 may range from 100 ns to 500 ns. When the length of the period t4 is equal to or more than 100 ns, the voltage Vcp of the first electrode Y sufficiently falls such that the first voltage V1 is set to a suitable magnitude for generating a sustain discharge. When the length of the period t4 is equal to or less than 500 ns, an excessive falling in the voltage Vcp of the first electrode Y is prevented. Further, when the positive sustain switch Q1 is turned on, a magnitude a voltage of applied to the positive sustain switch Q1 is reduced such that a stability of the circuit is secured.

Figure 6F:
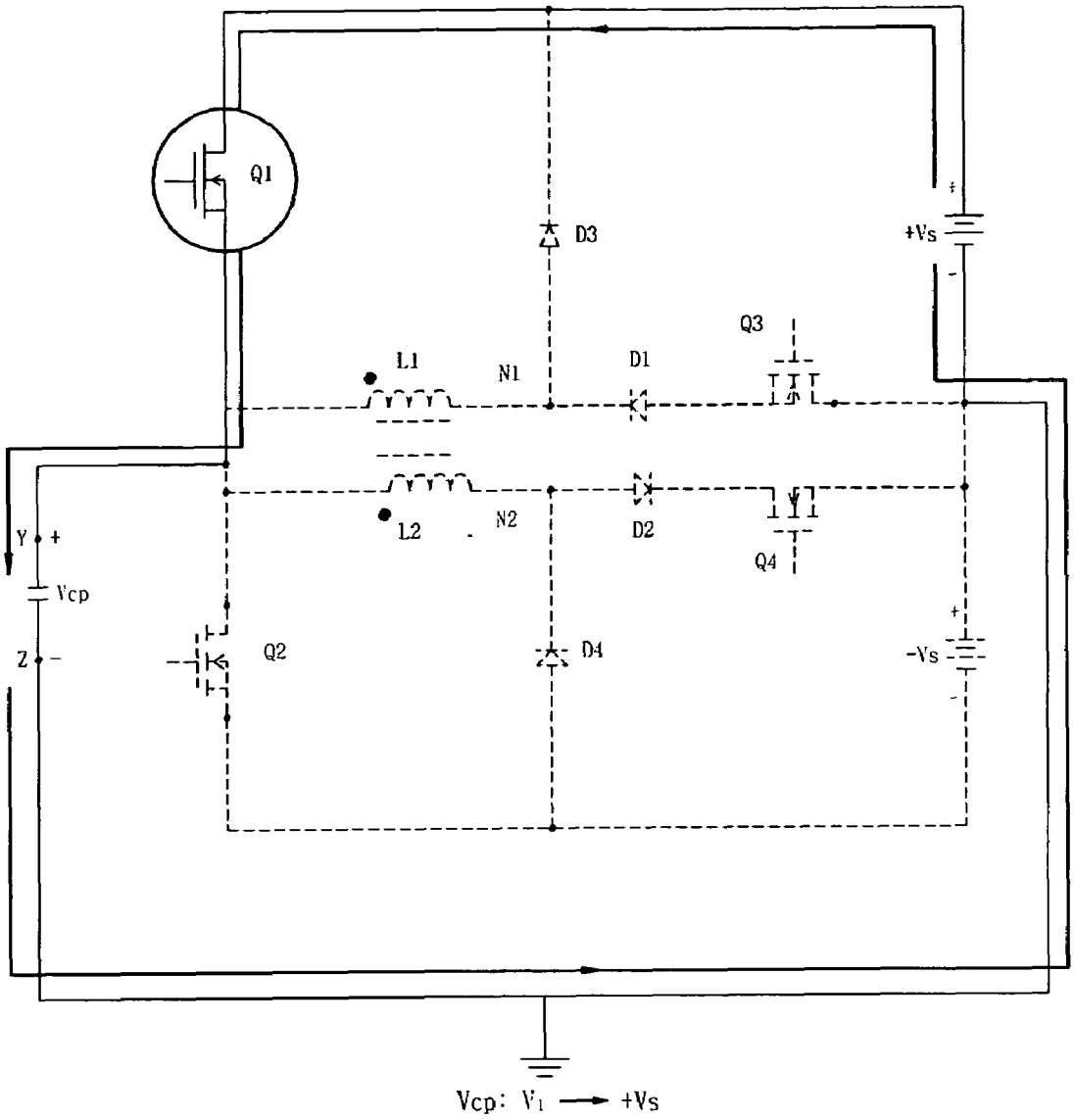

As illustrated in FIG. 6*f*, the positive sustain switch Q1 is turned on during the period t5-1 such that a current path passing through the positive sustain voltage source (+Vs), the positive sustain switch Q1, the first electrode Y, the second electrode Z, and the positive sustain voltage source (+Vs) is formed.

The charging current Icp sharply increases, and the voltage Vcp of the first electrode Y sharply rises from the first voltage V1 to the positive sustain voltage +Vs. again. Accordingly, a sustain discharge occurs inside the discharge cell of the plasma display panel 100 such that the second light emission is caused by the sustain discharge. The second light emission occurs due to the charging current Icp to the first electrode Y from the positive sustain voltage source (+Vs).

A luminance level of the second light emission is more than a luminance level of the first light emission. This reason is that a magnitude of the charging current Icp to the first electrode Y during the generation of the second light emission is more than a magnitude of the charging current Icp to the first electrode Y during the generation of the first light emission.

Figure 6G:
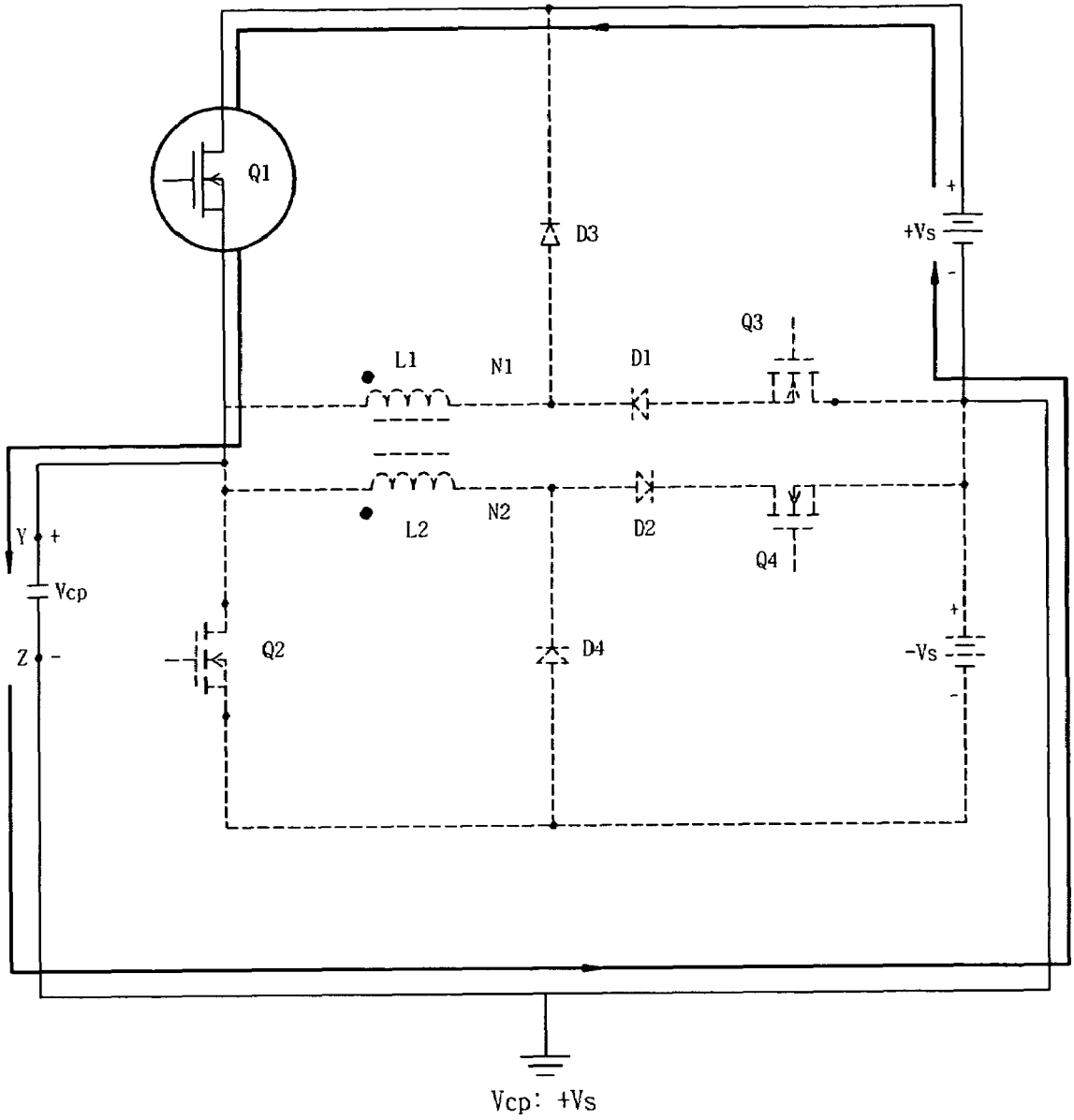

As illustrated in FIG. 6*g*, the positive sustain switch Q1 remains in a turn-on state during the period t5-2 such that a current path passing through the positive sustain voltage source (+Vs), the positive sustain switch Q1, the first electrode Y, the second electrode Z, and the positive sustain voltage source (+Vs) is formed. The voltage Vcp of the first electrode Y is maintained at the positive sustain voltage +Vs through the current path.

Figure 6H:
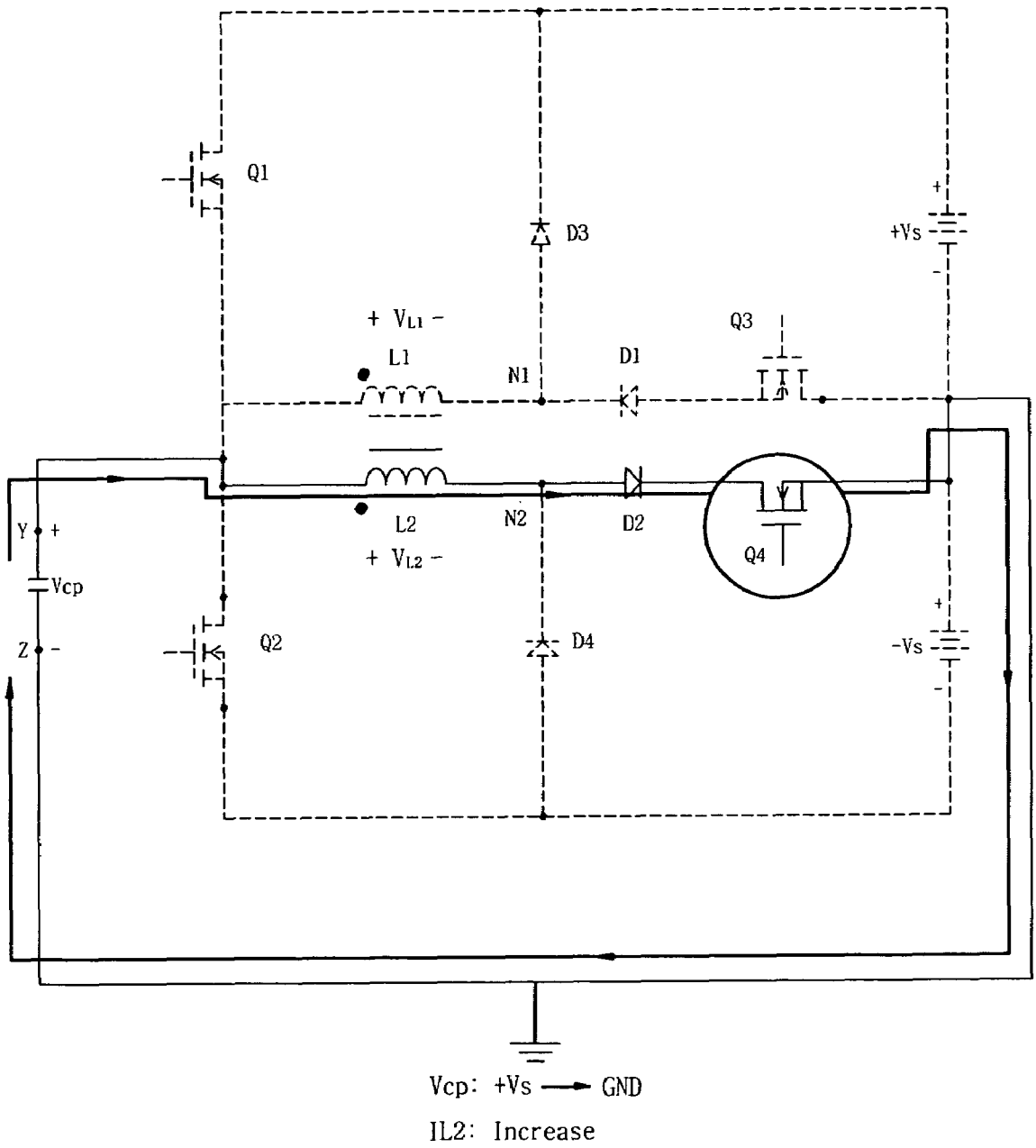

As illustrated in FIG. 6*h*, the second resonance switch Q4 is turned on during the period t6 such that a current path passing through the first electrode Y, the second inductor L2, the second reverse blocking diode D2, the second resonance switch Q4, and the second electrode Z is formed.

Resonance occurs between the second inductor L2 and the plasma display panel 100 through the current path such that the voltage Vcp of the first electrode Y falls from the positive sustain voltage +Vs to the ground level voltage GND.

Figure 6I:
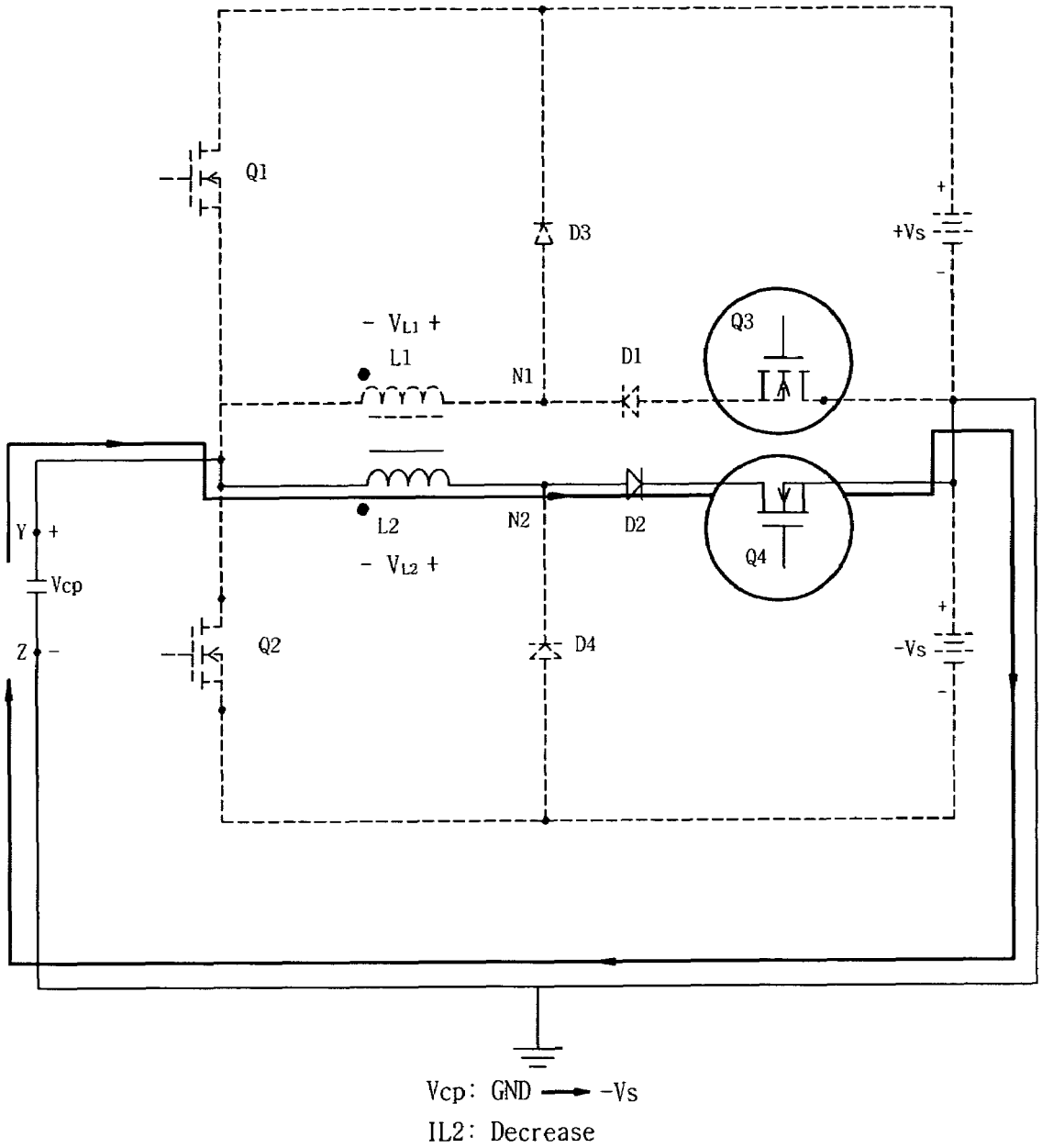

As illustrated in FIG. 6*i*, the second resonance switch Q4 remains in a turn-on state and the first resonance switch Q3 is turned on during the period t7-1 such that a current path passing through the first electrode Y, the second inductor L2, the second reverse blocking diode D2, the second resonance switch Q4, and the second electrode Z is formed.

Resonance generated between the second inductor L2 and the plasma display panel 100 is maintained through the current path such that the voltage Vcp of the first electrode Y falls from the ground level voltage GND to the negative sustain voltage −Vs. Accordingly, a sustain discharge occurs inside the discharge cell of the plasma display panel 100 such that the first light emission is caused by the sustain discharge.

A reason why the current IL1 does not flow in the first inductor L1 is that the voltage of the first node N1 is higher than the ground level voltage GND and is lower than the positive sustain voltage +Vs due to the voltage $V_{L1}$ of the first inductor L1 induced by mutual inductance. A reason why the current path does not pass through the second bypass diode D4 is that the voltage of the second node N2 is higher than the negative sustain voltage −Vs.

As above, during the periods t6 and t7-1, the voltage Vcp of the first electrode Y changes from the positive sustain voltage +Vs to the negative sustain voltage −Vs due to the resonance generated between the second inductor L2 and the plasma display panel 100.

Figure 6J:
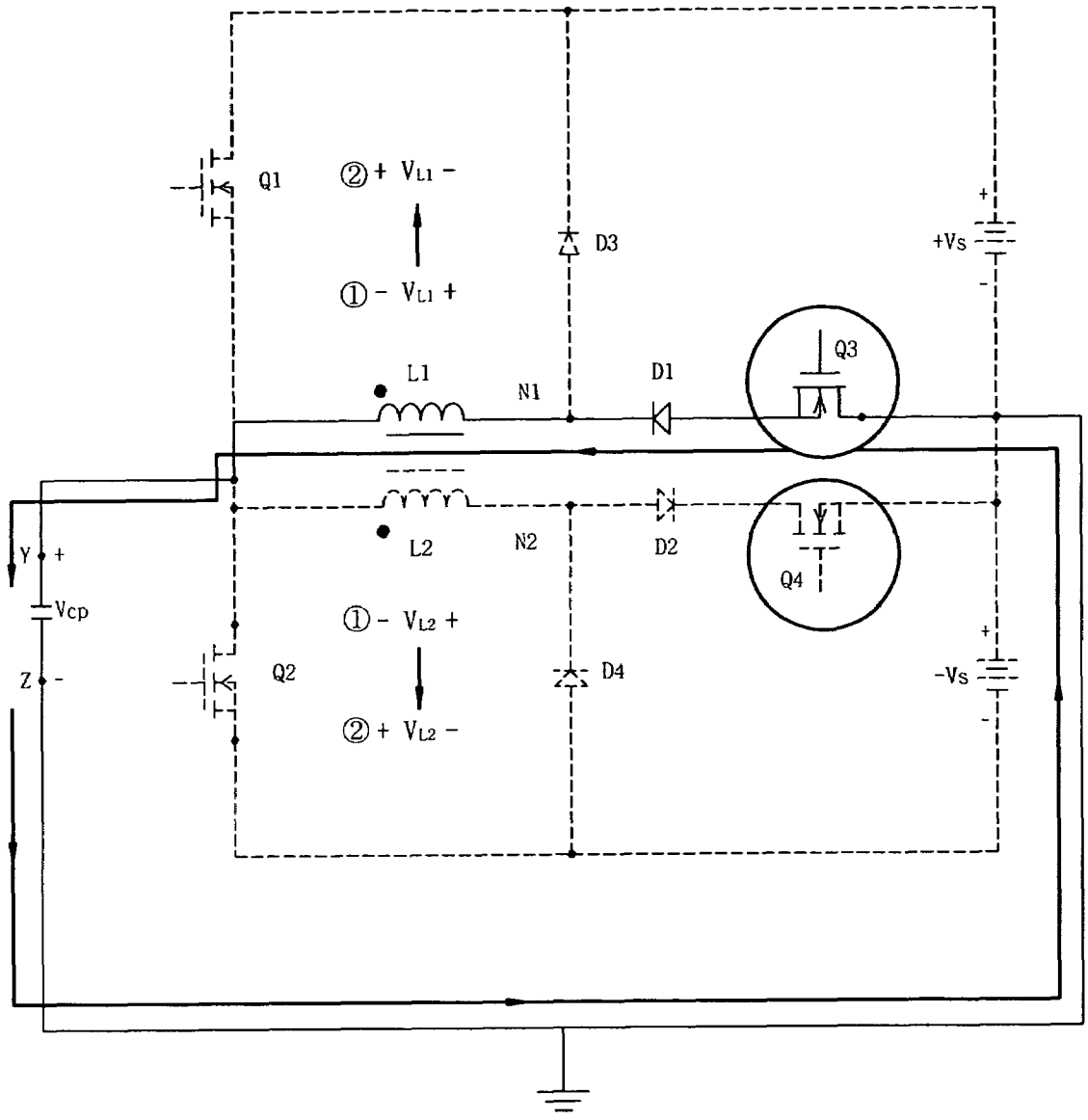

As illustrated in FIG. 6*j*, the first and second resonance switches Q3 and Q4 remain in a turn-on state during the period t7-2. Since the first and second resonance switches Q3 and Q4 remain in the turn-on state after the voltage Vcp of the first electrode Y falls to the negative sustain voltage −Vs due to the resonance, the current Icp is charged again. A current path passing through the second electrode Z, the first resonance switch Q3, the first reverse blocking diode D1, the first inductor L1, and the first electrode Z is formed.

The voltage Vcp of the first electrode Y rises from the negative sustain voltage −Vs, and the current IL1 flows in the first inductor L1 through the current path. As the current IL1 of the first inductor L1 gradually increases, a voltage (□$V_{L1}$) is induced to both terminals of the first inductor L1 and a voltage (□ $V_{L2}$) is induced to both terminals of the second inductor L2 due to mutual inductance.

Since the voltage of the first node n1 is lower than the positive sustain voltage +Vs, a current does not flows in the first bypass diode D3. A reason why a current path passing from the second inductor L2 toward the second reverse blocking diode D2 and a current path passing from the second bypass diode D4 toward the second inductor L2 are not formed is that the voltage of the second node N2 is lower than the ground level voltage GND and is higher than the negative sustain voltage −Vs due to the voltage (□ $V_{L2}$) induced to both terminals of the second inductor L2 due to the mutual inductance.

The period t7-2 ends and at the same time, the first and second resonance switches Q3 and Q4 are turned off. Therefore, the current IL1 flowing in the first inductor L1 is instantaneously reduced such that a voltage (□ $V_{L1}$) is induced to both terminals of the first inductor L1 and a voltage (□ $V_{L2}$) is induced to both terminals of the second inductor L2 due to mutual inductance. Magnitudes of the voltages (□ $V_{L1}$) and (□ $V_{L2}$) are equal to magnitudes of the voltages (□ $V_{L1}$) and (□ $V_{L2}$), respectively. Directions of the voltages (□ $V_{L1}$) and (□ $V_{L2}$) are opposite to directions of the voltages (□ $V_{L1}$) and (□ $V_{L2}$), respectively.

Figure 6K:
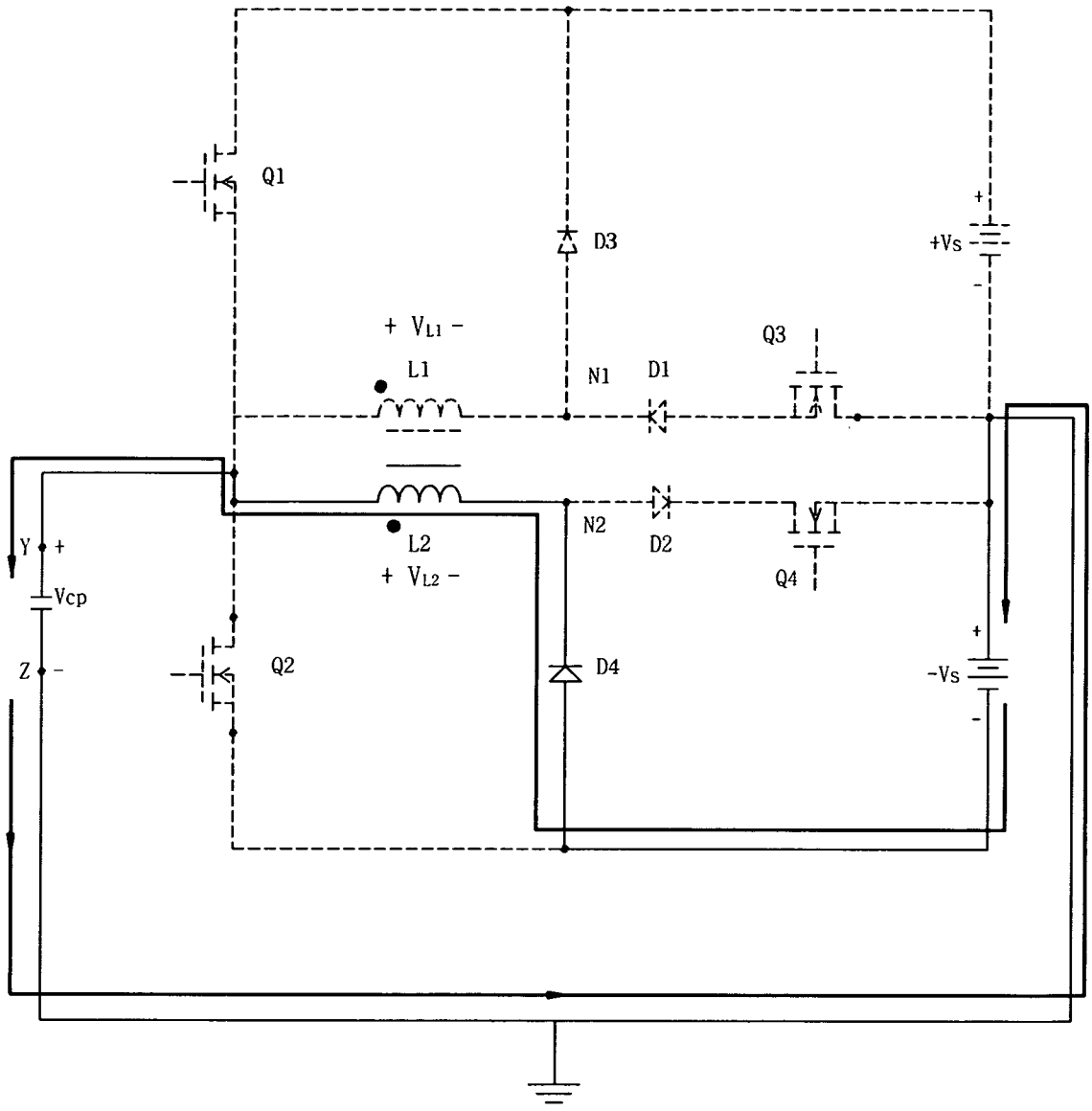
Figure 6I:
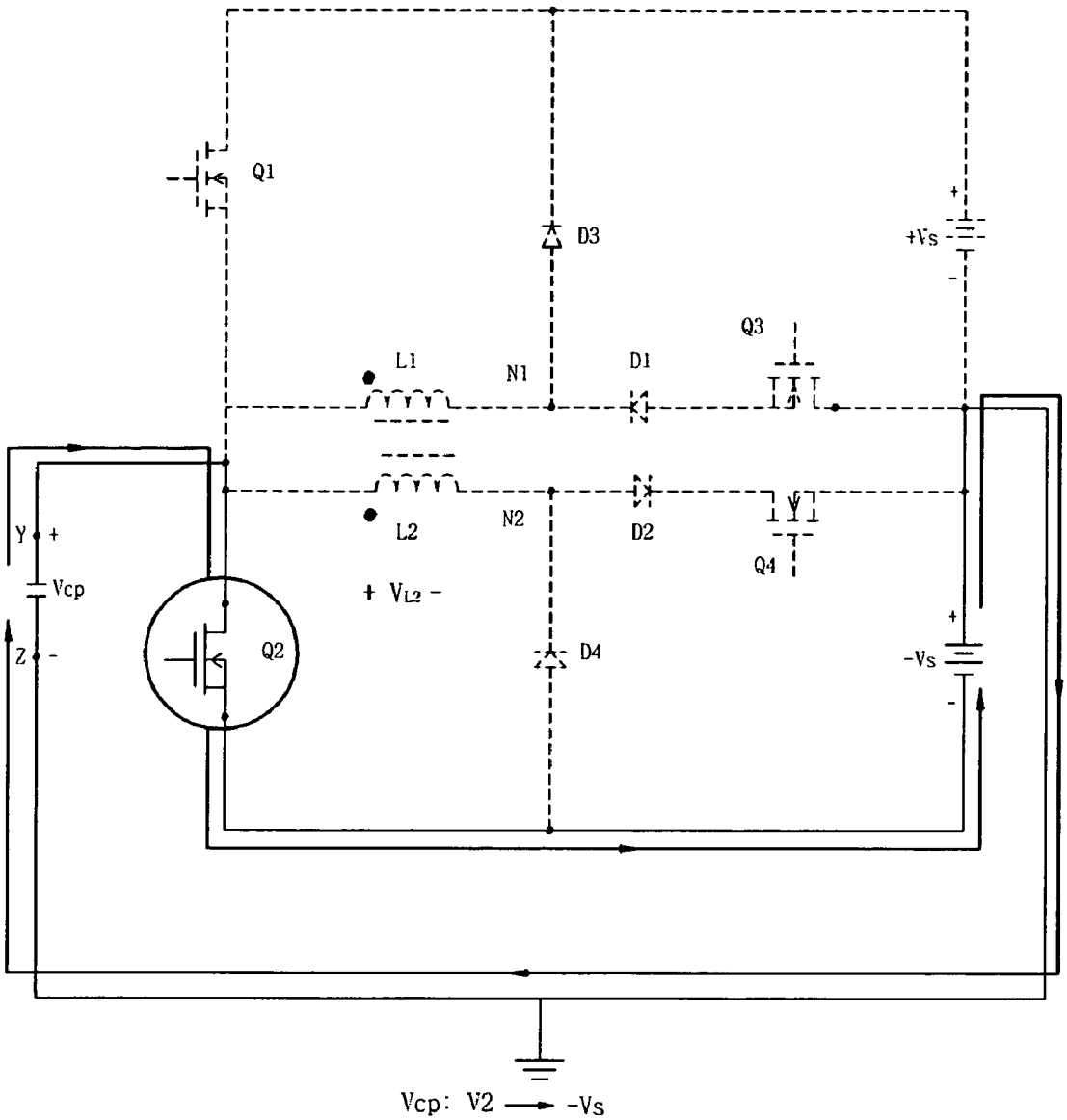

As illustrated in FIG. 6*j*, while the first and second resonance switches Q3 and Q4 are turned off during the period t8, the voltage (□ $V_{L2}$) is induced to both terminals of the second inductor L2 such that the voltage of the second node N2 is lower than the negative sustain voltage −Vs. Accordingly, as illustrated in FIG. 6*k*, a current path passing through the second electrode Z, the negative sustain voltage source (−Vs), the second bypass diode D4, the second inductor L2, and the first electrode Y is formed during the period t8. The voltage Vcp of the first electrode Y rises to the second voltage V2 through the current path.

As the induction voltage $V_{L2}$ gradually decreases, an induced current IL2 flowing in the second inductor L2 gradually decreases such that the current IL2 of the second inductor L2 is formed during the period t8 as illustrated in FIG. 5.

The magnitude of the second voltage V2 is determined by a length of the period t8 ranging from a turn-off time point of the first and second resonance switches Q3 and Q4 to a turn-on time point of the negative sustain switch Q2.

The length of the period t8 may range from 100 ns to 500 ns. When the length of the period t8 is equal to or more than 100 ns, the voltage Vcp of the first electrode Y sufficiently rises such that the second voltage V2 is set to a suitable magnitude for generating a sustain discharge. When the length of the period t8 is equal to or less than 500 ns, an excessive rising in the voltage Vcp of the first electrode Y is prevented. Further, when the negative sustain switch Q2 is turned on, a magnitude a voltage of applied to the negative sustain switch Q2 is reduced such that a stability of the circuit is secured.

As illustrated in FIG. 6*l*, the negative sustain switch Q2 is turned on during the period t9-1 such that a current path passing through the negative sustain voltage source (−Vs), the second electrode Z, the first electrode Y, the negative sustain switch Q2, and the negative sustain voltage source (−Vs) is formed.

The discharging current Icp Y sharply increases, and the voltage Vcp of the first electrode Y sharply falls from the second voltage V2 to the negative sustain voltage −Vs again. Accordingly, a sustain discharge occurs inside the discharge cell of the plasma display panel 100 such that the second light emission is caused by the sustain discharge.

Figure 6M:
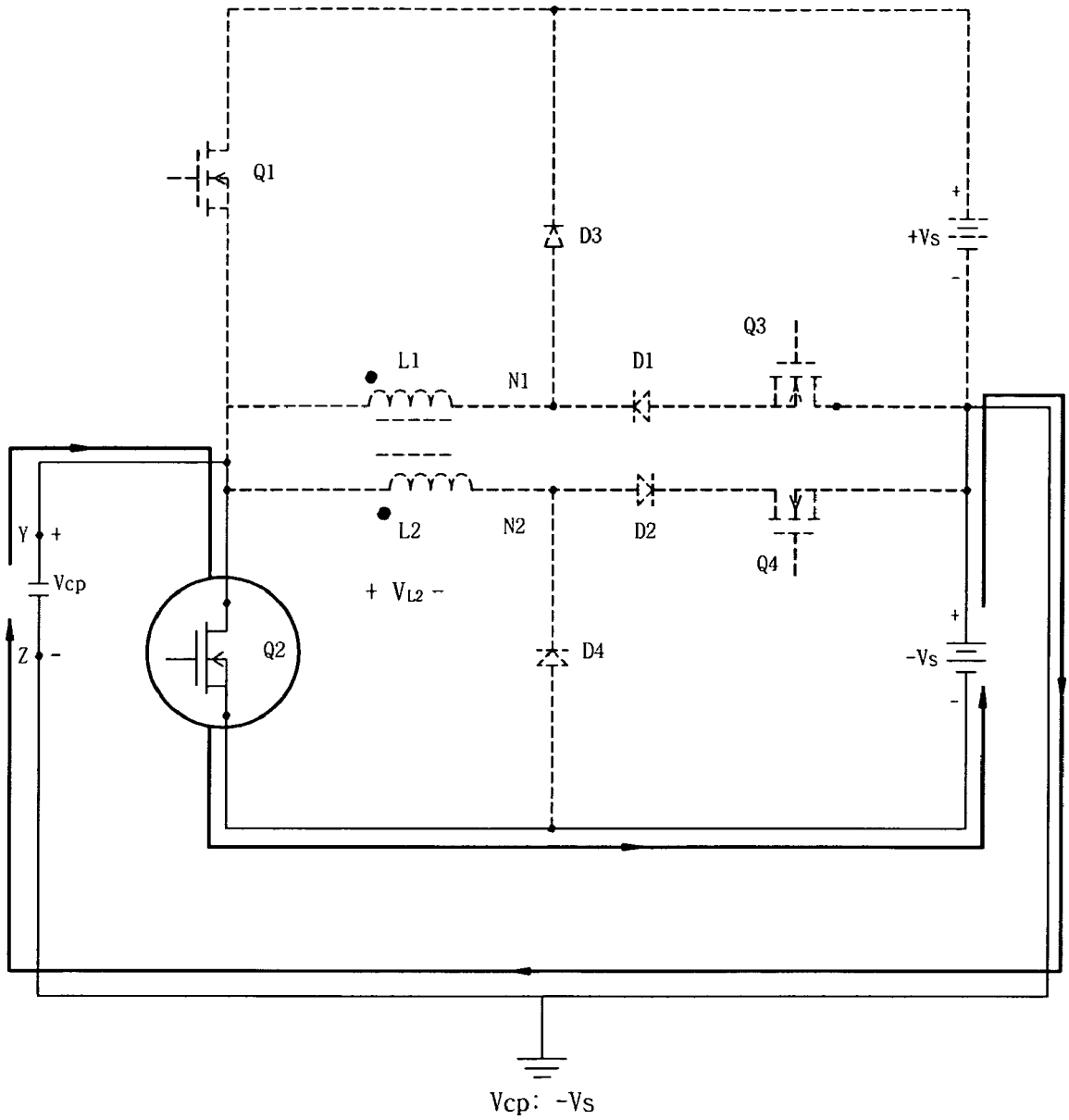

As illustrated in FIG. 6*m*, the negative sustain switch Q2 remains in a turn-on state during the period t9-2 such that a current path passing through the negative sustain voltage source (−Vs), the second electrode Z, the first electrode Y, the negative sustain switch Q2, and the negative sustain voltage source (−Vs) is formed. The voltage Vcp of the first electrode Y is maintained at the negative sustain voltage −Vs through the current path.

As above, one example of the driving method of the plasma display panel 100 illustrated in FIG. 5 generates two sustain discharges inside the discharge cell of the plasma display panel 100 during the sustain period by controlling switching timing of each switch such that the light emission efficiency is improved. Further, the switching timing of the switch is controlled to the luminance level of the second light emission to be more than the luminance level of the first light emission such that the stability of the circuit is secured efficiently.

The plasma display apparatus may be embedded variously other than the above description of the plasma display apparatus.

As one example, the second resonance switch may be turned off during the periods t3-1 and t7-2, and the first resonance switch may be turned off during the periods t3-2 and t7-1. In this case, two sustain discharges occur inside the discharge cell of the plasma display panel such that the light emission efficiency is improved.

As another example, the plasma display apparatus can be driven to generate two sustain discharges by one sustain signal in a case where a load applied to the positive sustain switch or the negative sustain switch is small, or in low gray level subfields where the number of sustain signals supplied during a sustain period is small. The plasma display apparatus can be driven to generate one sustain discharge by one sustain signal in a case where a load applied to the positive sustain switch or the negative sustain switch is large, or in high gray level subfields where the number of sustain signals supplied during a sustain period is much. Accordingly, the load applied to the positive sustain switch or the negative sustain switch is reduced and a margin of the sustain period increases.

As another example, two sustain discharges are generated by one sustain signal in either a case of supplying a sustain signal of a positive polarity or a case of supplying a sustain signal of a negative polarity.

The foregoing embodiments and advantages are merely exemplary and are not to be construed as limiting the present invention. The present teaching can be readily applied to other types of apparatuses. The description of the foregoing embodiments is intended to be illustrative, and not to limit the scope of the claims. Many alternatives, modifications, and variations will be apparent to those skilled in the art. In the claims, means-plus-function clauses are intended to cover the structures described herein as performing the recited function and not only structural equivalents but also equivalent structures. Moreover, unless the term "means" is explicitly recited in a limitation of the claims, such limitation is not intended to be interpreted under 35 USC 112(6).

What is claimed is:

1. A plasma display apparatus comprising:

a plasma display panel including a first electrode and a second electrode; and an integrated sustain driver that supplies a sustain signal of a positive polarity and a sustain signal of a negative polarity to the first electrode during a sustain period, wherein two light emissions occur during at least one period of a supply period of the sustain signal of the positive polarity or a supply period of the sustain signal of the negative polarity.

2. The plasma display apparatus of claim 1, wherein the integrated sustain driver includes an inductor unit for generating mutual inductance.

3. The plasma display apparatus of claim 1, wherein the integrated sustain driver generates a first light emission in the plasma display panel by resonance generated between the inductor unit and the plasma display panel, and the integrated sustain driver generates a second light emission in the plasma display panel using a positive sustain voltage supplied from a positive sustain voltage source or a negative sustain voltage supplied from a negative sustain voltage source.

4. The plasma display apparatus of claim 3, wherein a luminance level of the second light emission is more than a luminance level of the first light emission.

5. A plasma display apparatus comprising:

a plasma display panel including a first electrode and a second electrode;

a positive sustain controller that supplies a positive sustain voltage supplied from a positive sustain voltage source to the first electrode during a sustain period;

a negative sustain controller that supplies a negative sustain voltage supplied from a negative sustain voltage source to the first electrode during the sustain period;

an inductor unit that generates resonance with a plasma display panel and generates mutual inductance;

a resonance controller that control the generation of the resonance;

a reverse blocking unit that is electrically connected between the inductor unit and the resonance controller and prevents the flowing of an inverse current; and a bypass unit that forms a path of a current generated by the mutual inductance.

6. The plasma display apparatus of claim 5, wherein the inductor unit includes a first inductor that generates resonance to change a voltage of the first electrode from a negative voltage level to a positive voltage level, and a second inductor that generates resonance to change the voltage of the first electrode from a positive voltage level to a negative voltage level.

7. The plasma display apparatus of claim 6, wherein inductance of the first inductor is equal to inductance of the second inductor.

8. The plasma display apparatus of claim 6, wherein the resonance controller includes a first resonance switch that controls the generation of resonance for changing the voltage of the first electrode from a negative voltage level to a positive voltage level, and a second resonance switch that controls the generation of resonance for changing the voltage of the first electrode from a positive voltage level to a negative voltage level.

9. The plasma display apparatus of claim 8, wherein a first light emission occurs in the plasma display panel during a period where the first resonance switch or the second resonance switch is turned on.

10. The plasma display apparatus of claim 8, wherein the positive sustain controller includes a positive sustain switch, the negative sustain controller includes a negative sustain switch, and at least one of the positive sustain switch or the negative sustain switch is turned on after the passage of a predetermine period of time from a turn-off time point of the first resonance switch and the second resonance switch.

11. The plasma display apparatus of claim 10, wherein the predetermine period of time ranges from 100 ns to 500 ns.

12. The plasma display apparatus of claim 10, wherein a second light emission occurs in the plasma display panel during a period where at least one of the positive sustain switch or the negative sustain switch is turned on.

13. The plasma display apparatus of claim 8, wherein the reverse blocking unit includes a first reverse blocking diode that prevents an inverse current between the first inductor and the first resonance switch, and a second reverse blocking diode that prevents an inverse current between the second inductor and the second resonance switch.

14. The plasma display apparatus of claim 6, wherein the bypass unit includes a first bypass diode that forms a path of a current generated by an induction voltage of the first inductor induced by the mutual inductance, and a second bypass diode that forms a path of a current generated by an induction voltage of the second inductor induced by the mutual inductance.

15. A method of driving a plasma display panel including a first electrode and a second electrode, the method comprising:

maintaining a voltage of the first electrode at a negative sustain voltage;

gradually rising the voltage of the first electrode from the negative sustain voltage to a positive sustain voltage;

gradually falling the voltage of the first electrode from the positive sustain voltage to a first voltage, that is lower than the positive sustain voltage and is higher than the ground level voltage;

rising the voltage of the first electrode from the first voltage to the positive sustain voltage;

maintaining the voltage of the first electrode at the positive sustain voltage;

gradually falling the voltage of the first electrode from the positive sustain voltage to the negative sustain voltage;

gradually rising the voltage of the first electrode from the negative sustain voltage to a second voltage, that is higher than the negative sustain voltage and is lower than the ground level voltage; and falling the voltage of the first electrode from the second voltage to the negative sustain voltage.

16. The method of claim 15, wherein a first light emission occurs in the plasma display panel through at least one of the gradual rising of the voltage of the first electrode from the negative sustain voltage to the positive sustain voltage, or the gradual falling of the voltage of the first electrode from the positive sustain voltage to the negative sustain voltage.

17. The method of claim 16, wherein a second light emission occurs in the plasma display panel through at least one of the rising of the voltage of the first electrode from the first voltage to the positive sustain voltage, or the falling of the voltage of the first electrode from the second voltage to the negative sustain voltage.

18. The method of claim 17, wherein a luminance level of the second light emission is more than a luminance level of the first light emission.

* * * * *